US011525289B2

(12) United States Patent
Cumbo

(10) Patent No.: US 11,525,289 B2
(45) Date of Patent: Dec. 13, 2022

(54) VEHICULAR CLOSURE LATCH ASSEMBLY WITH ROLLER-TYPE LATCH MECHANISM AND CINCH MECHANISM

(71) Applicant: MAGNA CLOSURES INC., Newmarket (CA)

(72) Inventor: Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 885 days.

(21) Appl. No.: 16/034,435

(22) Filed: Jul. 13, 2018

(65) Prior Publication Data

US 2019/0017301 A1 Jan. 17, 2019

Related U.S. Application Data

(60) Provisional application No. 62/533,314, filed on Jul. 17, 2017.

(51) Int. Cl.

| | |
|---|---|
| ***E05B 81/20*** | (2014.01) |
| ***E05B 81/72*** | (2014.01) |
| ***E05B 81/66*** | (2014.01) |
| ***E05B 85/24*** | (2014.01) |
| ***E05B 85/26*** | (2014.01) |

(52) U.S. Cl.

CPC ..... *E05B 81/20* (2013.01); *E05B 81/66* (2013.01); *E05B 81/72* (2013.01); *E05B 85/243* (2013.01); *E05B 85/26* (2013.01)

(58) Field of Classification Search

CPC ..... E05B 81/20; E05B 81/66; E05B 85/26; E05B 85/243; Y10T 292/1082; Y10T 292/1047; Y10S 292/23

See application file for complete search history.

(56) References Cited

U.S. PATENT DOCUMENTS

| | | | | |
|---|---|---|---|---|
| 5,918,917 | A | 7/1999 | Elton et al. | |
| 6,550,825 | B2 | 4/2003 | Ostrowski et al. | |
| 6,848,727 | B1 | 2/2005 | Cetnar et al. | |
| 7,175,212 | B2 | 2/2007 | Cetnar et al. | |
| 9,903,143 | B2 * | 2/2018 | Hiramoto | E05B 81/68 |
| 10,358,846 | B2 * | 7/2019 | Hanaki | E05B 83/40 |
| 10,378,252 | B2 * | 8/2019 | Ottino | E05B 81/68 |
| 10,619,384 | B2 * | 4/2020 | Im | E05B 81/16 |

(Continued)

FOREIGN PATENT DOCUMENTS

| | | | |
|---|---|---|---|
| CN | 1108730 | A | 9/1995 |
| CN | 103670065 | A | 3/2014 |

(Continued)

*Primary Examiner* — Kristina R Fulton
*Assistant Examiner* — Noah Horowitz
(74) *Attorney, Agent, or Firm* — Dickinson Wright PLLC

(57) ABSTRACT

A latch assembly for a motor vehicle closure system having a latch mechanism, a latch release mechanism and a power cinching mechanism. The latch mechanism is operable in a released state when a closure panel is located in an open position, in a secondary closed state when the closure panel is located in a partially-closed position, and in a primary closed state when the closure panel is located in a fully-closed position. The cinching mechanism interacts with the latch mechanism to establish the secondary closed state and is actuated for shifting the latch mechanism from its secondary closed state into its primary closed state.

22 Claims, 26 Drawing Sheets

(56) References Cited

U.S. PATENT DOCUMENTS

| | | | | |
|---|---|---|---|---|
| 10,745,947 | B2 * | 8/2020 | Okeke | E05B 17/007 |
| 10,767,397 | B2 * | 9/2020 | Ottino | E05B 81/20 |
| 2010/0117379 | A1 | 5/2010 | Mitchell et al. | |
| 2016/0186468 | A1 | 6/2016 | Ilea | |
| 2016/0244999 | A1 | 8/2016 | Ottino et al. | |
| 2017/0051540 | A1 | 2/2017 | Okeke et al. | |
| 2017/0089103 | A1 | 3/2017 | Ottino et al. | |
| 2018/0100331 | A1 | 4/2018 | Cumbo | |
| 2018/0171677 | A1 | 6/2018 | Im et al. | |
| 2021/0095499 | A1 * | 4/2021 | Sturm | E05B 81/20 |

FOREIGN PATENT DOCUMENTS

| | | | |
|---|---|---|---|
| DE | 19913590 | C2 | 11/2003 |
| DE | 19861199 | B4 | 4/2007 |
| EP | 1176273 | A2 | 1/2002 |
| EP | 1048808 | B1 | 10/2004 |

* cited by examiner

VEHICULAR CLOSURE LATCH ASSEMBLY WITH ROLLER-TYPE LATCH MECHANISM AND CINCH MECHANISM

CROSS-REFERENCE TO RELATED APPLICATION

This application claims the benefit of and priority to U.S. Provisional Application Ser. No. 62/533,314 filed Jul. 17, 2017. The disclosure of the above application is incorporated by reference herein as if fully set forth in its entirety.

FIELD

The present disclosure relates generally to closure latch assemblies of the type used in vehicle closure systems for releasably securing a closure panel relative to a body portion of a motor vehicle. More particularly, the present disclosure is directed to a power-operated closure latch assembly equipped with a roller-type latch mechanism and a latch cinch mechanism arranged to provide a power cinching function.

BACKGROUND

This section provides background information related to latch assemblies of the type used in motor vehicle closure systems and which is not necessarily prior art to the inventive concepts associated with the present disclosure.

In view of increased consumer demand for motor vehicles equipped with advanced comfort and convenience features, many modern motor vehicles are now provided with passive entry systems to permit locking and release of closure panels (i.e. doors, tailgates, liftgates, decklids, etc.) without the use of traditional key-type manual entry systems. In this regard, some of the more popular features now available with vehicular closure systems include power unlocking/locking, power release, power child locks, and power cinching. These "powered" features are typically integrated into a latch assembly mounted to the closure panel and which is equipped with a ratchet/pawl type of latch mechanism that is controlled via at least one electric actuator. Movement of the closure panel from an open position toward a closed position results in a striker (mounted to a structural portion of the vehicle) engaging and forcibly rotating the ratchet, in opposition to biasing normally applied to the ratchet via a ratchet biasing member, from a striker release position toward a striker capture position. Once the ratchet is located in its striker capture position, the pawl moves into a ratchet holding position whereat the pawl engages and holds the ratchet in its striker capture position, thereby latching the latch mechanism and holding the closure panel in its closed position. In most modern latch assemblies of the type equipped with such a ratchet/pawl latch mechanism, the pawl is operable in its ratchet holding position to retain the ratchet in both of a primary (i.e. "hard close") striker capture position when the closure panel is located in a fully-closed position and a secondary (i.e. "soft close") striker capture position when the closure panel is located in a partially-closed position.

Latch assemblies providing a power release feature typically include a latch release mechanism actuated by an electric "power release" actuator for causing the pawl to move from its ratchet holding position into a ratchet releasing position whereat the pawl is disengaged from the ratchet. Thereafter, the ratchet biasing member moves the ratchet from one of its primary and secondary striker capture positions into its striker release position, thereby releasing the latch mechanism and permitting movement of the vehicle closure panel to its open position. The power release actuator is controlled by a latch control unit in response to a latch release signal generated by the passive entry system (i.e. via a key fob or a handle-mounted switch).

Latch assemblies providing a power cinching feature typically include a latch cinch mechanism actuated by an electric "power cinch" actuator and configured to cause the ratchet to move from its secondary striker capture position into its primary striker capture position, thereby moving the closure panel from its partially-closed position into its fully-closed position. The latch cinch mechanism is normally maintained in a non-actuated condition and is only shifted into an actuated condition when sensors associated with the latch mechanism indicate that the ratchet is located in its secondary striker capture position. Following completion of the power cinching operation, when the sensors indicate that the ratchet is located in its primary striker capture position, the latch cinch mechanism is reset. Specifically, the latch cinch mechanism is returned to its non-actuated condition so as to permit uninhibited movement of the ratchet to its striker release position in response to subsequent actuation of the latch release mechanism. Obviously, if the closure panel is initially closed with sufficient closing force to locate the ratchet in its primary striker capture position, then the cinching operation is bypassed and the latch cinch mechanism is maintained in its non-actuated condition.

To ensure that precipitation and road debris do not enter the vehicle, all vehicular closure panels are equipped with resilient weather seals disposed around their periphery and which are configured to seal against a mating surface of the vehicle body surrounding the closure opening. These weather seals also function to reduce wind noise and are configured to compress upon latching of the closure panel in its fully-closed position relative to the vehicle body. As is well recognized, increasing the compressive seal force applied to the weather seals provides improved noise reduction within the passenger compartment of the motor vehicle. However, these seal forces also tend to drive the closure panel toward its open position, thereby loading the latch mechanism. As such, undesirably high latch release forces, required to release the latch mechanism, are established along the engagement interface between the ratchet and the pawl. These high latch release forces detrimentally impact the size and power requirements of the power release actuator which, in turn, drives up the overall cost and size of the latch assembly. To address this shortcoming, it is known to equip the latch assembly with a double ratchet/pawl type of latch mechanism. As a further alternative, it is known to modify the single ratchet/pawl type of latch mechanism with a roller-type engagement feature such as is shown in commonly-owned U.S. Publication No. US 2017/0051540.

While current power-operated latch assemblies are sufficient to meet all regulatory requirements and provide desired levels of enhanced comfort and convenience, a need continues to exist directed toward advancing the technology and providing alternative power-operated closure latch assemblies and sub-systems that address and overcome at least some of the known shortcomings associated with conventional closure latch arrangements.

For latches with power cinching, the controller needs to know the position of the ratchet (released, primary engaged, secondary engaged position), in order to know when to begin and when to stop the cinching motor. Typically, switches triggered by either the ratchet or the pawl, or both, tend to report on the ratchet position. FIG. 23 shows a prior art switching strategy. One switch is triggered by the ratchet, and another switch is triggered by the pawl. The ratchet switch has an OFF state when the ratchet is rotated into the release position, and an ON state when the ratchet is rotates past the secondary and preferably close to the primary engagement positions. To compensate for operational variances, there is a slight lag between the ratchet reaching the primary engagement position and the ratchet switch indicating that the ratchet is engaged. The pawl switch has an OFF position that corresponds to the pawl being actuated away from the ratchet, and an ON position, which corresponds to when the pawl retains the ratchet in either the secondary or primary engagement positions. One problem with this switch strategy is that the switches report the same state (OFF and OFF) when the ratchet is in the primary engagement position, and an interlude between the primary and secondary engagement positions. For example if the door remains between the primary and secondary position after a manual closing for a reason (i.e.: a low seal load), the pawl is indicated in the OFF position yet the ratchet ajar is not yet in the ON state, and the switch still indicates the OFF. Thus the states of the switches correspond to the OPEN position of the door yet the door is in a partially closed position. This means the controller is not able to distinguish the partially closed state of the door from an open state and thus will not proceed to power the cinch leading to a cinch malfunction. The inability for the switches to properly indicate the position of the ratchet is known as a blind spot.

SUMMARY

This section provides a general summary of some of the inventive concepts associated with the present disclosure. Accordingly, this section is not intended to be interpreted as a comprehensive and exhaustive listing of all features, aspects, objectives and/or advantages associated with the inventive concepts of the present disclosure that are further described and illustrated in the detailed description provided herein.

It is an objective of the present disclosure to provide a power-operated latch assembly that meets the above-identified needs and provides a technological advancement over known power-operated latch assemblies.

It is another objective of the present disclosure to provide a latch assembly for a motor vehicle closure system equipped with a latch mechanism, a power-operated latch release mechanism, and a power-operated latch cinch mechanism.

It is a further objective of the present disclosure to incorporate a plurality of technical solutions into the power-operated latch assembly to effectively reduce power release (i.e. opening) force requirements, provide enhanced power cinch functionality, and provide mechanical cinch disengagement functionality.

It is still a further objective of the present disclosure to employ the power-operated latch cinch mechanism to hold the ratchet of the latch mechanism in a secondary striker capture position without direct latched engagement between the pawl and the ratchet, and to further employ the power-operated latch cinch mechanism to move the ratchet from its secondary striker capture position into a primary striker capture position whereat the pawl moves into engagement with the ratchet while the latch cinch mechanism is subsequently moved out of engagement with the ratchet. The requirement of having an additional pawl to maintain the ratchet in the secondary striker capture position is also not required, reducing the complexity and packaging size of the closure latch assembly.

In accordance with these and other objectives, the present disclosure is directed to a closure latch assembly comprising: a latch mechanism having a ratchet moveable between a striker release position whereat the ratchet is positioned to release a striker, a secondary (soft-close) striker capture position and a primary (hard-close) striker capture position, a ratchet biasing member for normally biasing the ratchet toward its striker release position, a pawl moveable between a ratchet holding position whereat the pawl is positioned to hold the ratchet in its primary striker capture position and a ratchet releasing position whereat the pawl is positioned to permit movement of the ratchet to its striker release position, and a pawl biasing member for normally biasing the pawl toward its ratchet holding position; a latch release mechanism having a release lever engaging the pawl and moveable between a non-actuated position whereat the release lever permits the pawl to be located in its ratchet holding position and an actuated position whereat the release lever causes the pawl to move to its ratchet releasing position, and a release lever biasing member for normally biasing the release lever toward its non-actuated position; a latch cinch mechanism having a cinch link moveable between a rest position whereat a lock notch on the cinch link is disengaged from a ratchet post extending from the ratchet when the ratchet is located in its striker release position and an engaged position whereat the lock notch on the cinch link engages the ratchet post on the ratchet when the ratchet is located in its secondary striker capture position; and an actuation mechanism having a cinch lever operably moveable from a cinch start position to a cinch stop position for causing the cinch link to move from its engaged position to a ratchet cinched position which causes the ratchet to rotate from its secondary striker capture position to its primary striker capture position due to continued engagement of the lock notch on the cinch link with the ratchet post on the ratchet so as to provide a power cinching function.

In accordance with another aspect, the ratchet has an elongated edge profile provided within a first plane of the ratchet defining a latch shoulder engaged by the pawl to hold the ratchet in its primary striker capture position, and a ratchet engagement member is provided within a second plane of the ratchet, the second plane being adjacent to the first plane.

In accordance with another aspect, the cinch lever, the release lever, and the cinch link, interact with one another through upstanding members projecting from the cinch lever, the release lever, and/or the cinch link, the upstanding members engageable within slots provided within the adjacent one or more of the cinch lever, the release lever, and the cinch link.

In accordance with another aspect, the cinch actuation mechanism is operable to stop moving the cinch link from driving the cinch link engagement member into the ratchet engagement member upon feedback from a second sensor that the ratchet is located in its primary striker capture position.

In accordance with another aspect, the cinch actuation mechanism is operable to stop moving the cinch link from driving the cinch link engagement member into the ratchet engagement member upon feedback from a second sensor that the ratchet is located in an over travel position from its primary striker capture position.

In accordance with another aspect, the second sensor is configured to provide a signal when the ratchet moves to its primary striker capture position, and the sensor is configured to provide a signal when the latch cinch mechanism moves to an actuated position indicating the ratchet is located in its secondary striker capture position.

The above-noted closure latch assembly of the present disclosure is further operable such that subsequent movement of the actuation mechanism from the cinch stop position back to the cinch start position results in movement of the cinch link from its ratchet cinched position to its rest position, whereby the lock notch is disengaged from the ratchet post to provide a cinch reset function while the pawl holds the ratchet in its primary striker capture position.

The above-noted latch assembly of the present disclosure is further operable such that movement of the release lever from its non-actuated position to its actuated position acts to move the cinch link from its ratchet cinched position to its rest position to provide a cinch override feature.

Further areas of applicability will become apparent from the detailed description provided herein. The description and specific examples disclosed in this summary are provided for purposes of illustration only and do not act to limit the scope of the present disclosure.

DRAWINGS

The drawings described herein are provided to illustrate selected, non-limiting embodiments associated with the present disclosure and are not intended to limit the scope of the present disclosure.

Figure 21A:
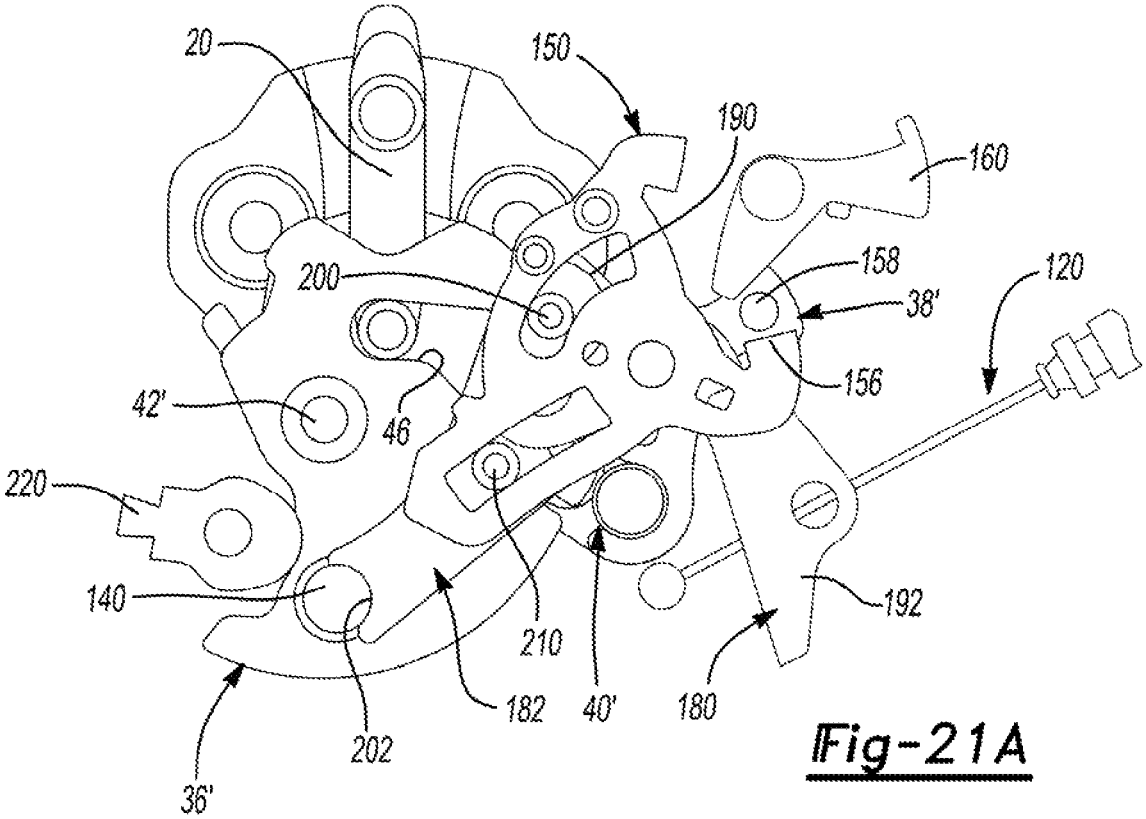
Figure 21B:
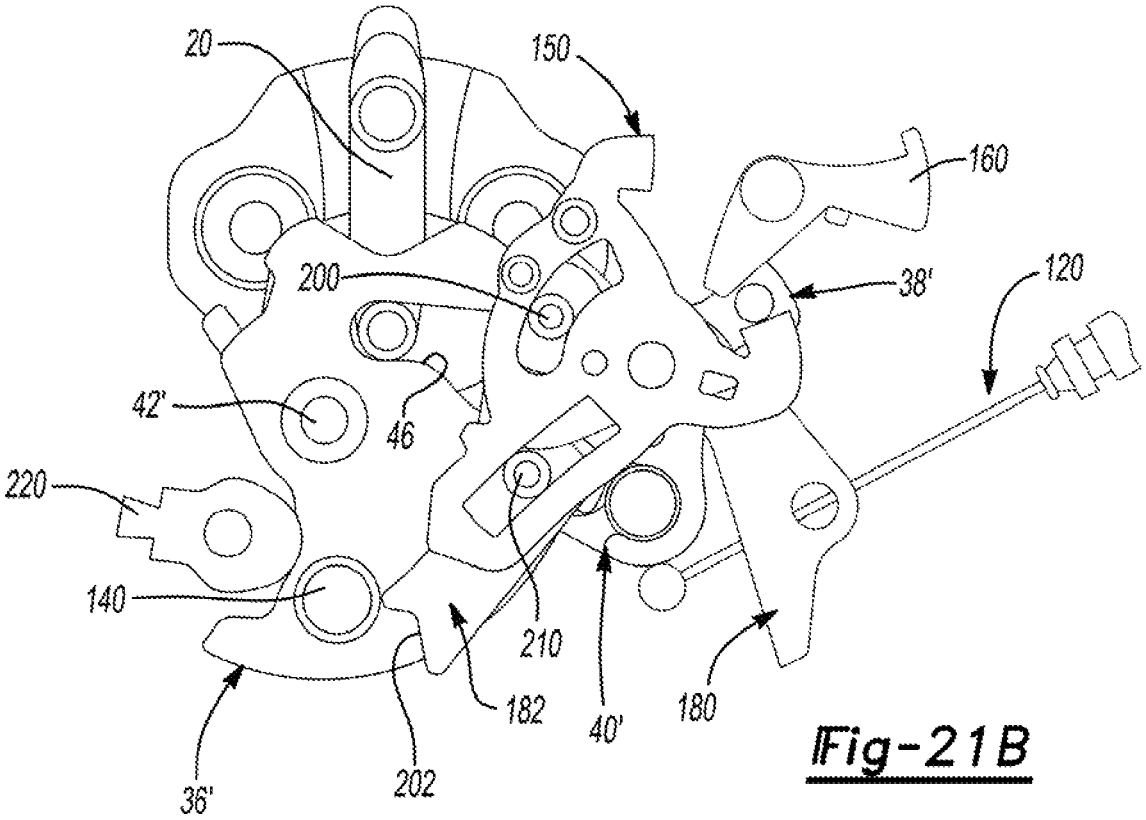
Figure 21C:
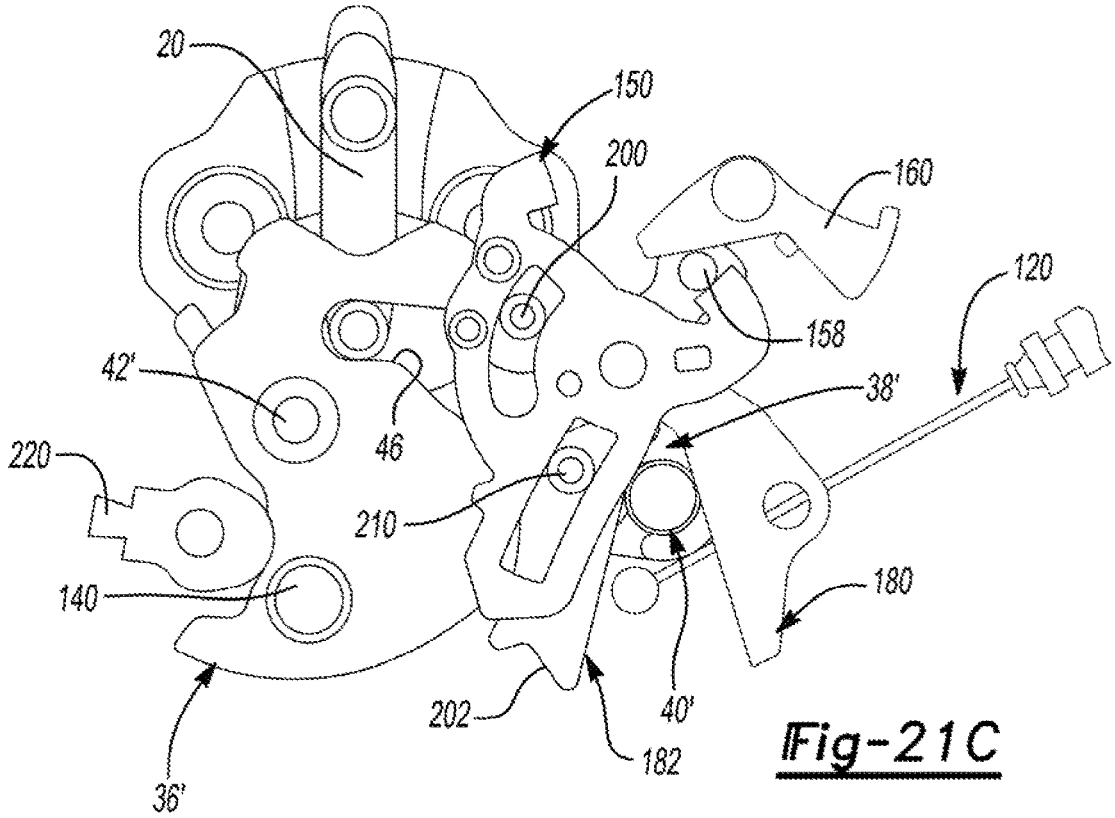
Figure 22A:
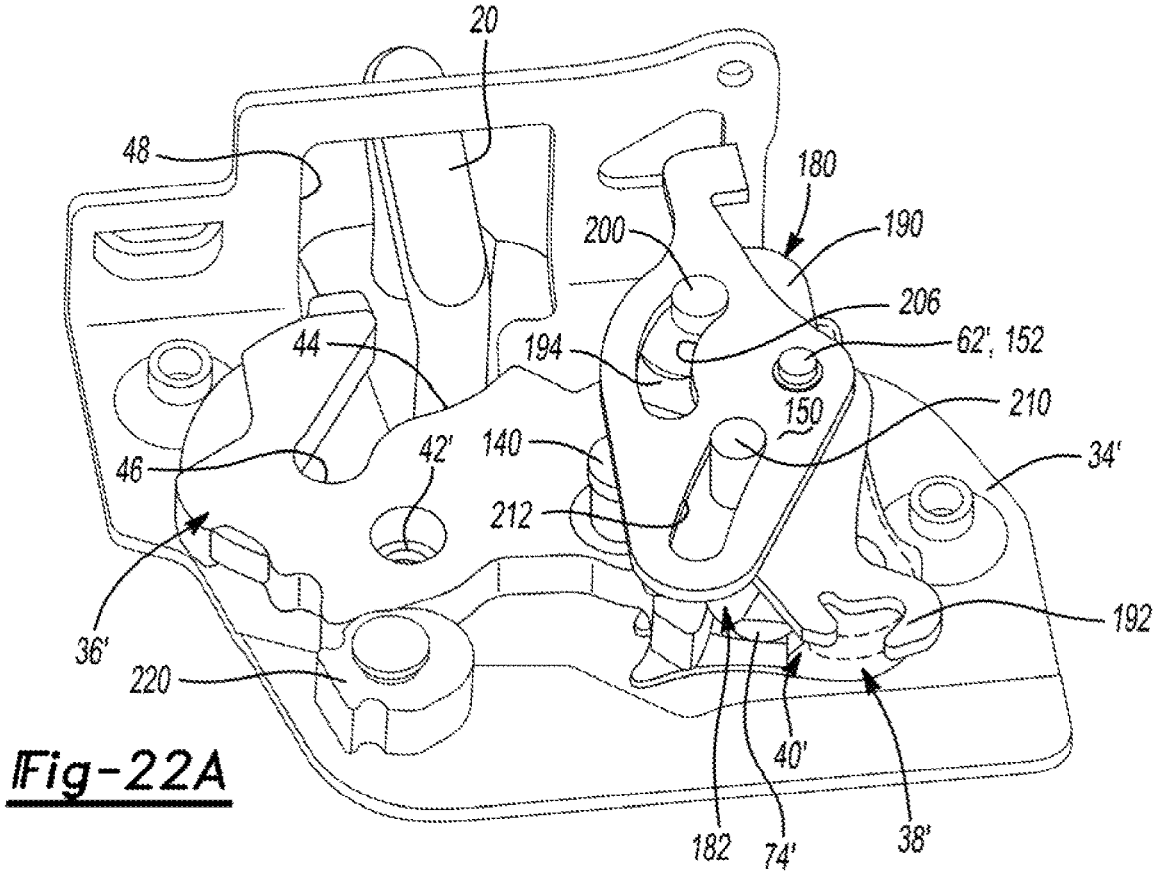
Figure 22B:
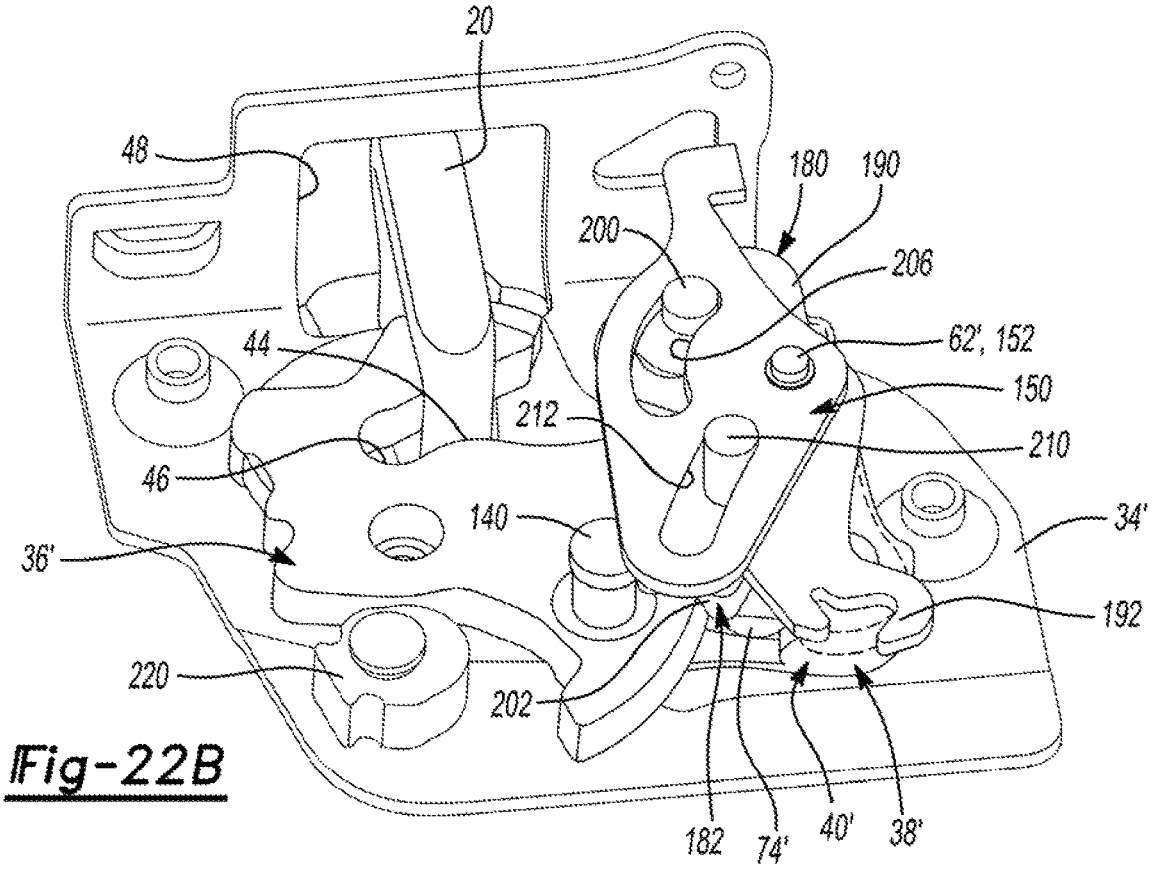
Figure 22C:
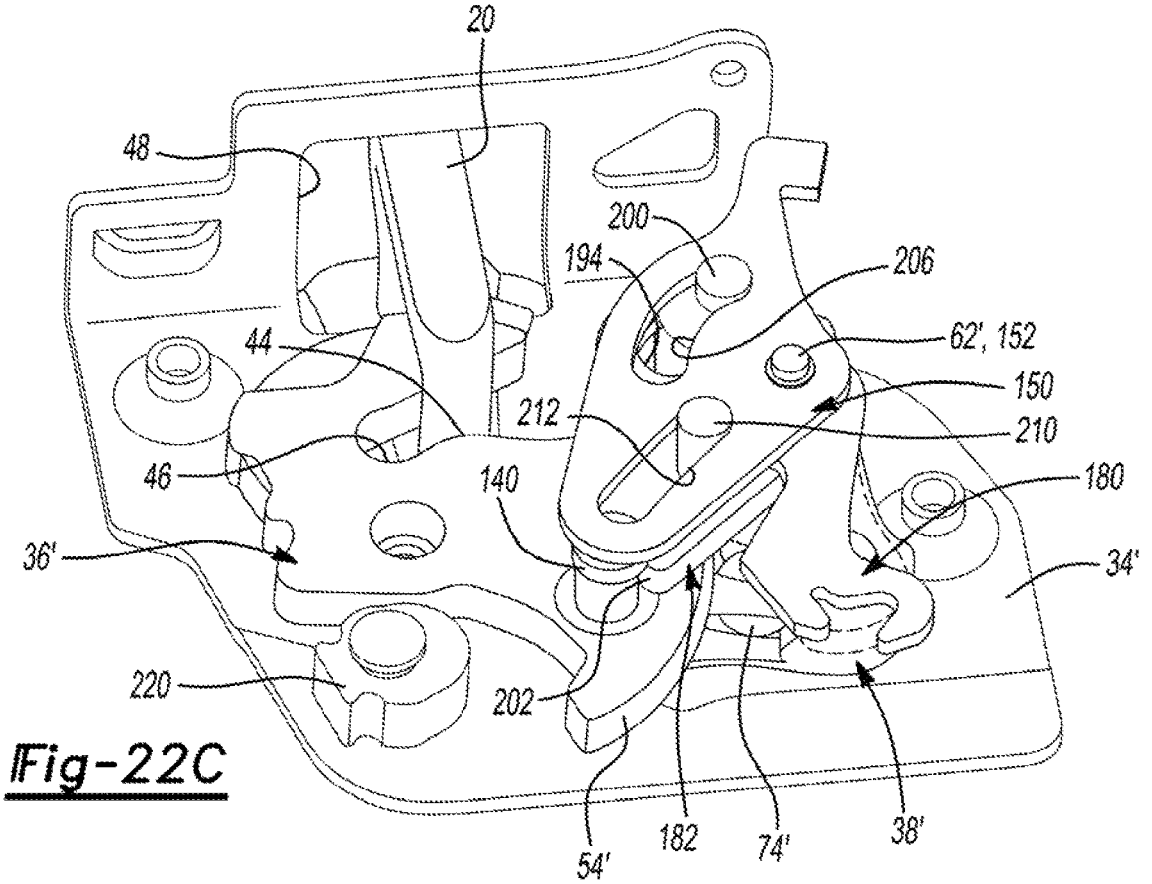
Figure 22D:
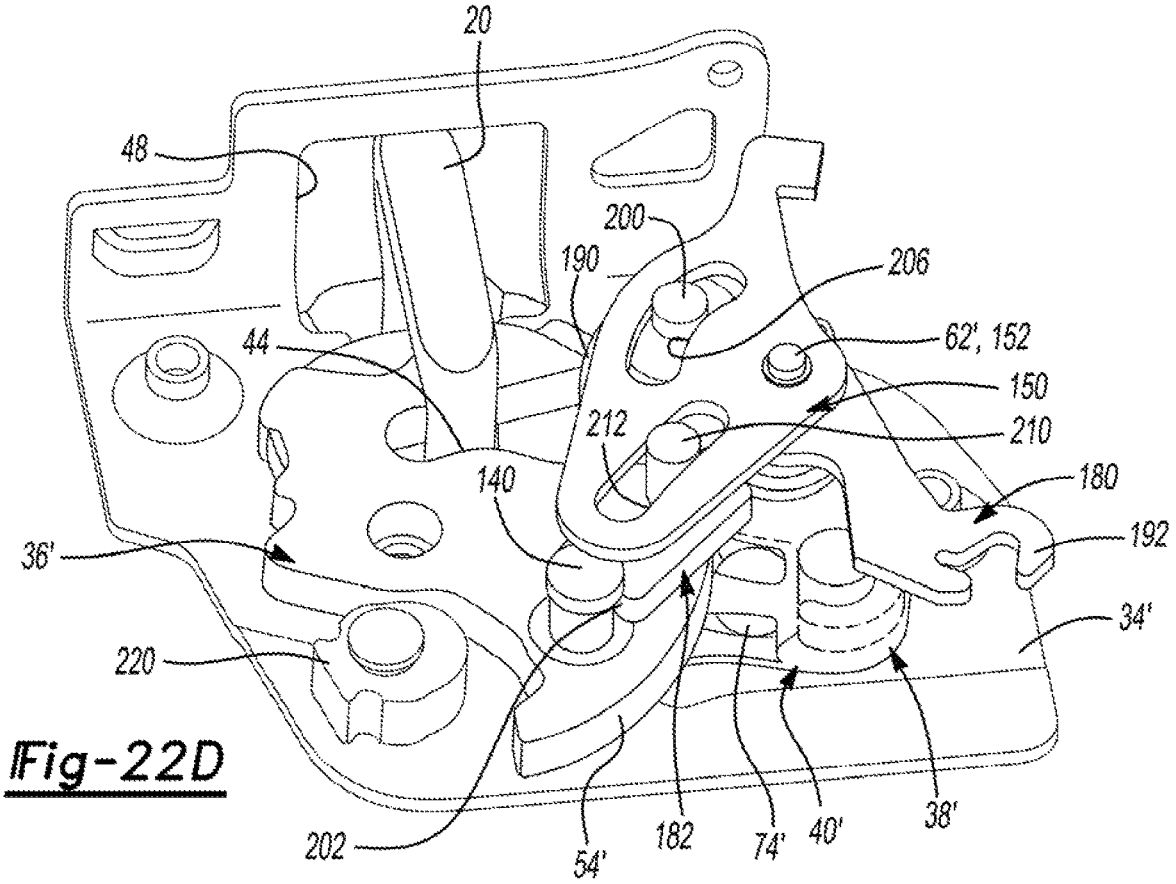
Figure 22E:
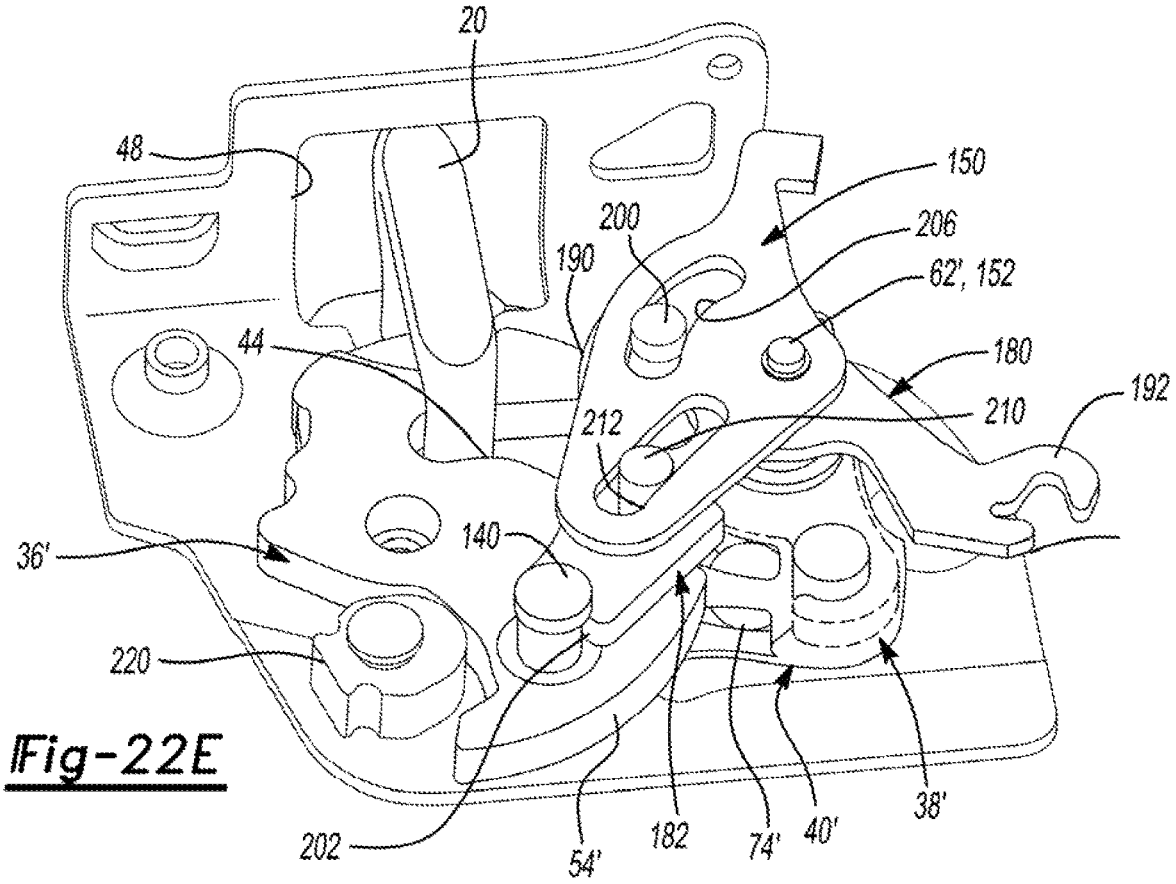
Figure 22F:
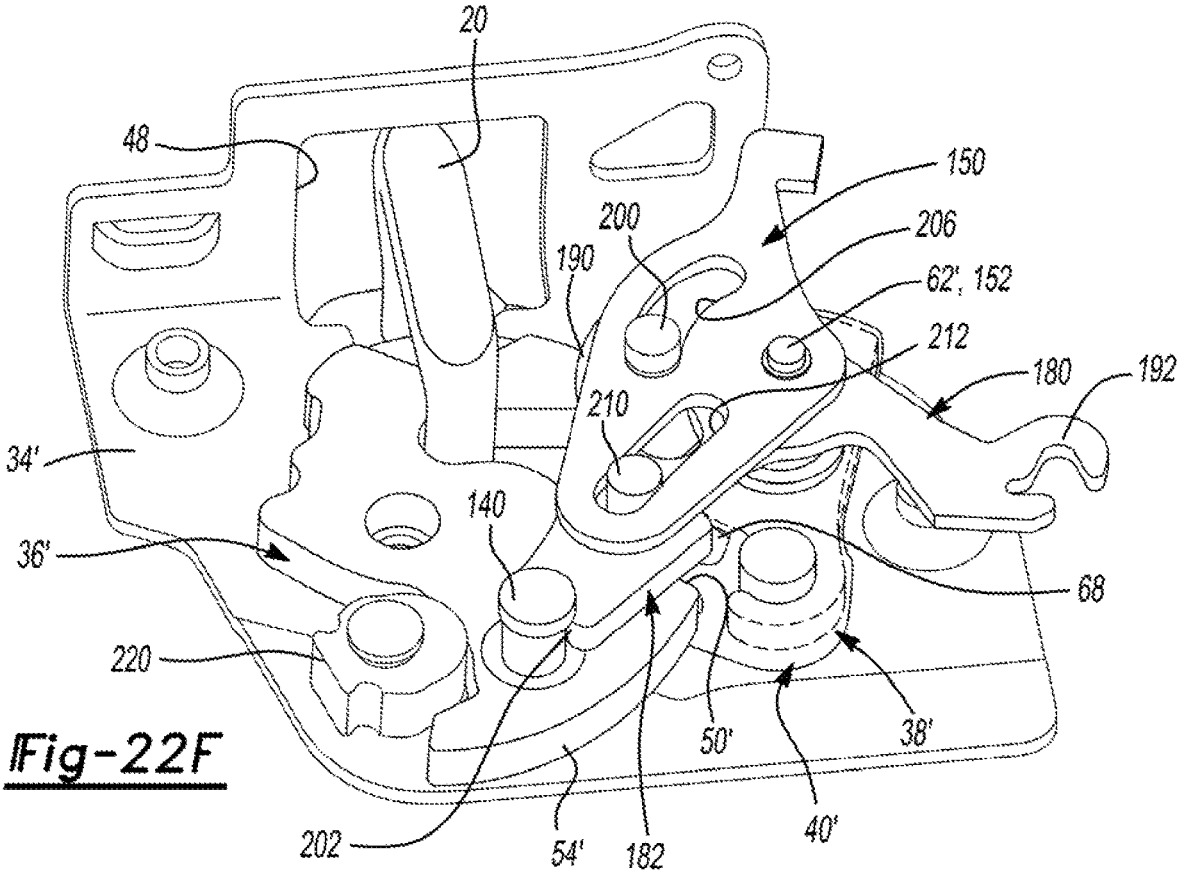
Figure 22G:
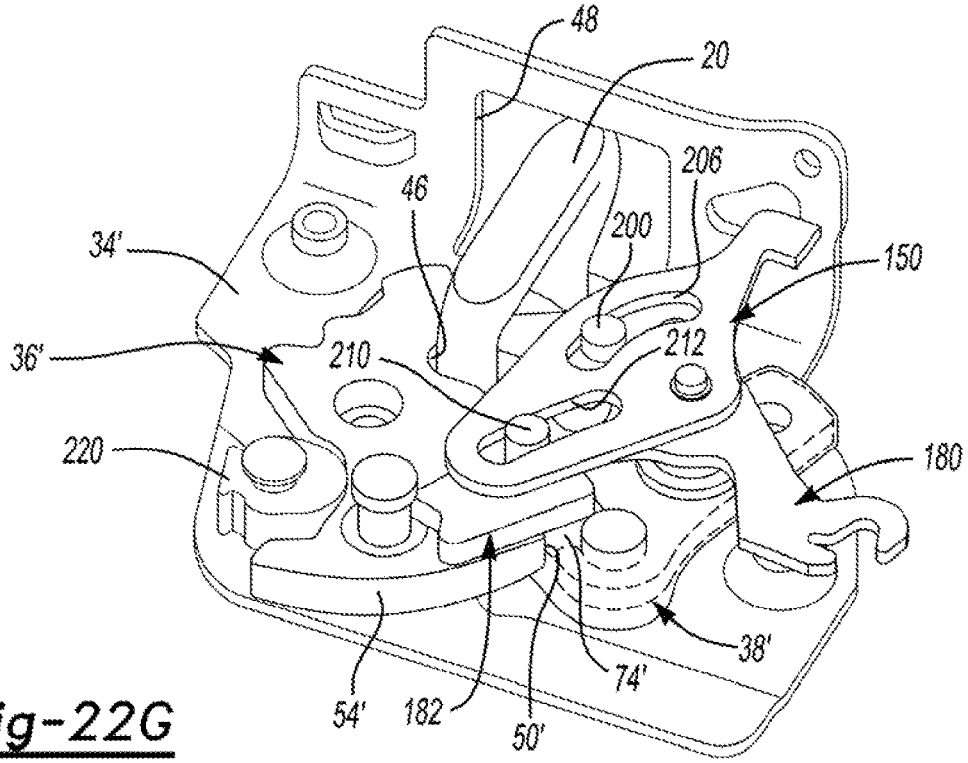
Figure 23:
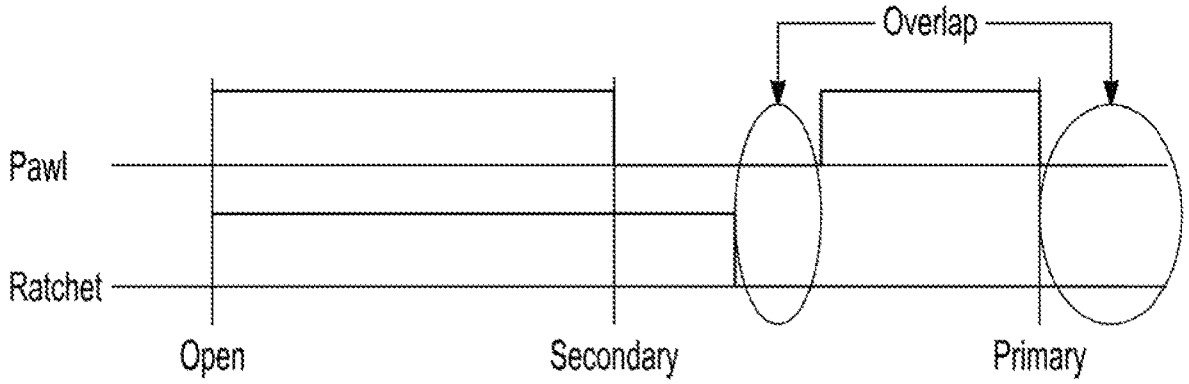
Fig-23 PRIOR ART

FIGS. 21A through 21C sequentially illustrate movement of the components associated with a cinch override operation;

FIGS. 22A through 22G illustrate a series of sequential isometric views showing the transition of the latch mechanism from its released state (FIG. 22A) into its secondary closed state (FIG. 22C), subsequent actuation of the power cinch actuator for causing the latch cinch mechanism to shift the latch mechanism from its secondary closed state (FIG. 22C) into its primary closed state (FIG. 22F), and subsequent disengagement and resetting of the latch cinch mechanism (FIG. 22G); and FIG. 23 shows a prior art switching strategy.

Corresponding reference numbers are used to indicate corresponding components throughout the several views of the drawings.

DETAILED DESCRIPTION

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail.

In the following detailed description, the expression "latch assembly" will be used to generally, as an illustrative example, indicate any power-operated latch device adapted for use with a vehicle closure panel to provide a power cinch feature in combination with a power release feature, but other configurations, such as a manually-operated cinch or release features could be provided. Additionally, the expression "closure panel" will be used to indicate any element moveable between an open position and at least one closed position, respectively opening and closing an access to an inner compartment of a motor vehicle and therefore includes, without limitations, decklids, tailgates, liftgates, bonnet lids, and sunroofs in addition to the sliding or pivoting side passenger doors of a motor vehicle to which the following description will make explicit reference, purely by way of example.

Figure 1:
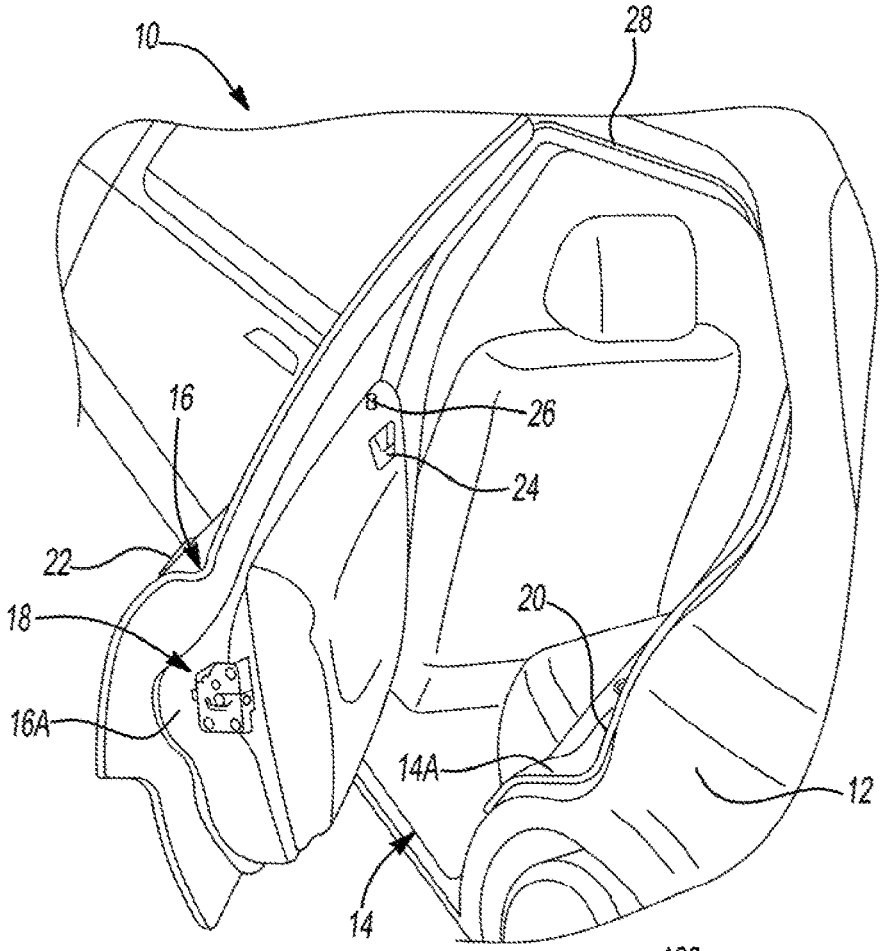
FIG. 1 is a partial perspective view of a motor vehicle having a closure panel equipped with a closure latch assembly constructed in accordance with the teachings of the present disclosure.

Referring initially to FIG. 1 of the drawings, a motor vehicle 10 is shown to include a vehicle body 12 defining an opening 14 to an interior passenger compartment. A closure panel 16 is pivotably mounted to body 12 for movement between an open position (shown), a partially-closed position, and a fully-closed position relative to opening 14. A latch assembly 18 is rigidly secured to closure panel 16 adjacent to an edge portion 16A thereof and is releasably engageable with a striker 20 that is fixedly secured to a recessed edge portion 14A of opening 14. As will be detailed, latch assembly 18 housing a latch mechanism 32 is operable to engage striker 20 and releaseably hold closure panel 16 in one of its partially-closed and fully-closed positions. An outside handle 22 and an inside handle 24 are provided for actuating (i.e. mechanically and/or electrically) latch assembly 18 to release striker 20 and permit subsequent movement of closure panel 16 to its open position. An optional lock knob 26 is shown which provides a visual indication of the locked state of latch assembly 18 and which may also be operable to mechanically change the locked state of latch assembly 18. A weather seal 28 is mounted on edge portion 14A of opening 14 in vehicle body 12 and is adapted to be resiliently compressed upon engagement with a mating sealing surface on closure panel 16 when closure panel 16 is held by latch assembly 18 in its fully-closed position so as to provide a sealed interface therebetween which is configured to prevent entry of rain and dirt into the passenger compartment while minimizing audible wind noise. For purpose of clarity and functional association with motor vehicle 10, the closure panel is hereinafter referred to as door 16.

Figure 2:
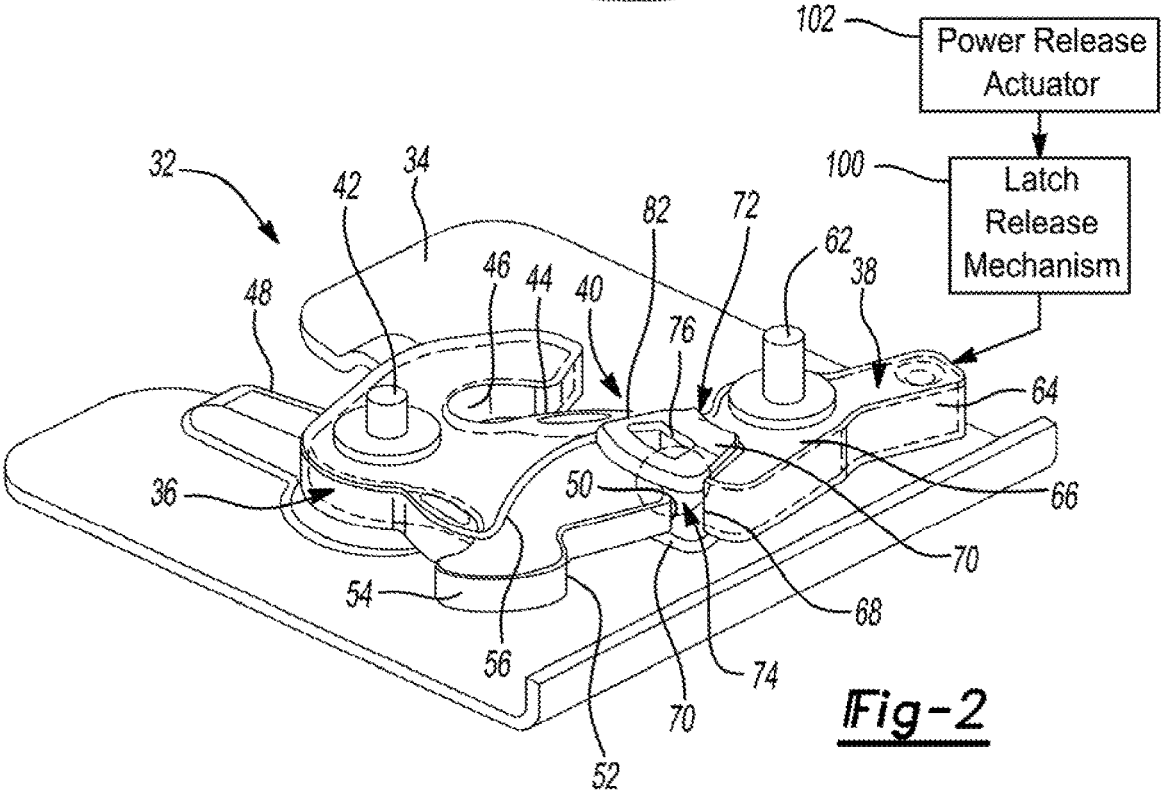
FIG. 2 is an isometric view of a roller-type latch mechanism associated with the closure latch assembly shown in FIG. 1.
Figure 3:
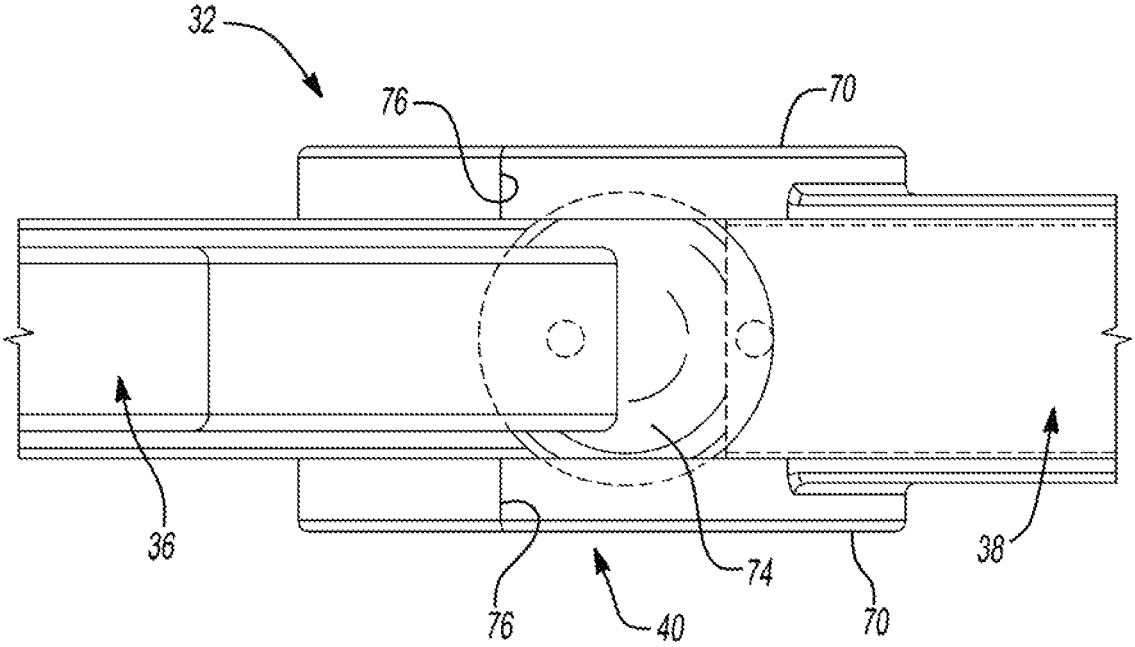
FIG. 3 is a partial side view of the latch mechanism shown in FIG. 2.

Referring now primarily to FIGS. 2, 3 and 4, various components of a latch mechanism 32 are shown pivotably mounted to a latch frame plate 34 and generally include a ratchet 36, a pawl 38, and a roller-type engagement device 40. Ratchet 36 is supported by a ratchet pivot post 42 for movement between a striker release position (FIG. 4A), a soft close or secondary striker capture position (FIG. 4B), and a hard close or primary striker capture position (FIGS. 4C and 4D). Ratchet 36 includes a striker guide channel 44 terminating in a striker retention cavity 46. As seen, latch frame plate 34 includes a fishmouth slot 48 aligned to accept movement of striker 20 relative thereto. Ratchet 36 includes a primary latch notch 50, a secondary latch notch 52, and an edge surface 54. A raised guide surface 56 is also formed on ratchet 36. Arrow 58 indicates a ratchet biasing member that is arranged to normally bias ratchet 36 toward its striker release position.

Pawl 38 is shown pivotably mounted to latch frame plate 34 about a pawl pivot post 62 and includes a first pawl leg segment 64 and a second pawl leg segment 66 defining a pawl engagement surface 68. Roller-type engagement device 40 is secured to second pawl leg segment 66 of pawl 38 and includes a pair of oppositely-disposed sidewalls 70 defining a cage 72, and a roller, shown as a spherical ball bearing 74, that is retained by cage 72 within aligned roller slots 76 formed in sidewalls 70. Pawl 38 is pivotable between a ratchet releasing position (FIG. 4A) and a ratchet holding position (FIGS. 4B, 4C and 4D). Pawl 38 is normally biased toward its ratchet holding position by a pawl biasing member, indicated by arrow 80.

Figure 4A:
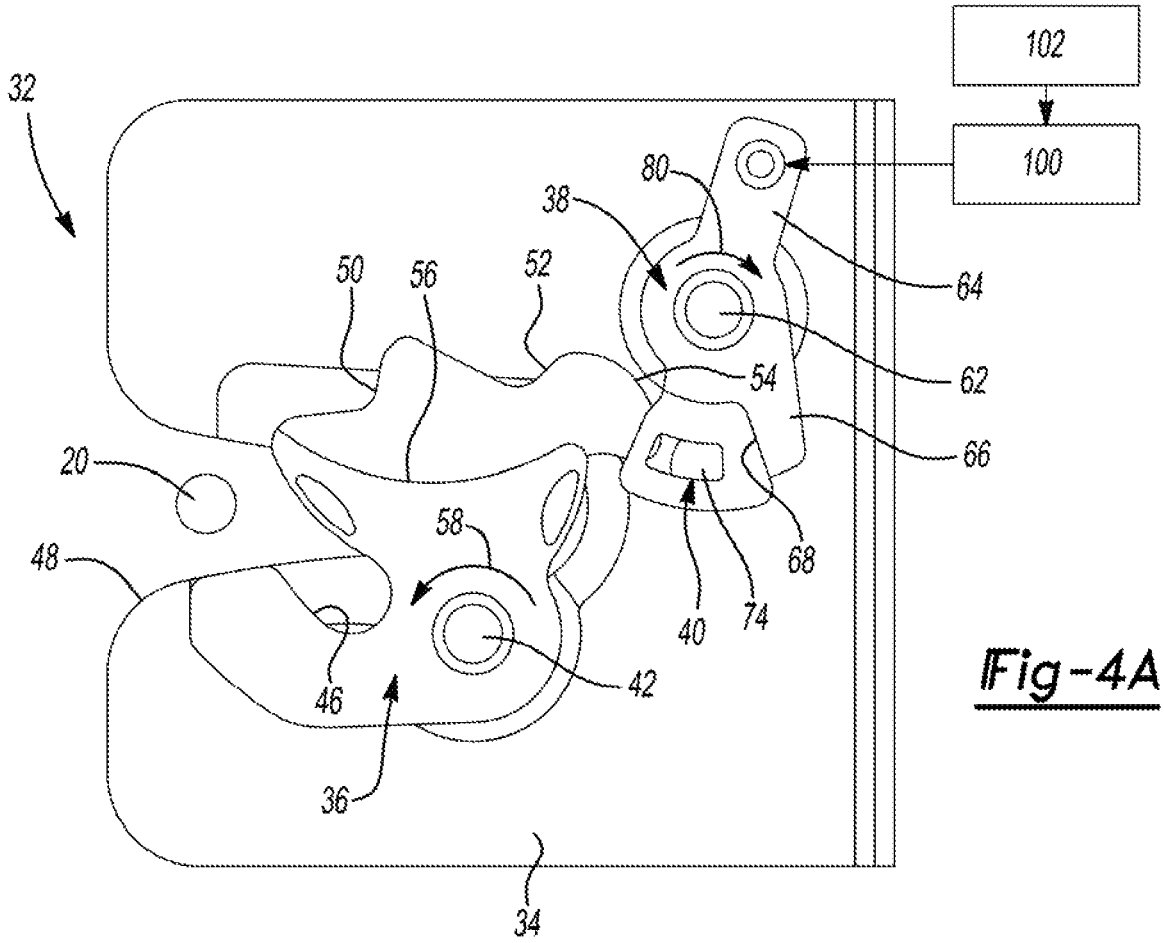
FIG. 4A is a plan view illustrating the latch mechanism in a released state.
Figure 4B:
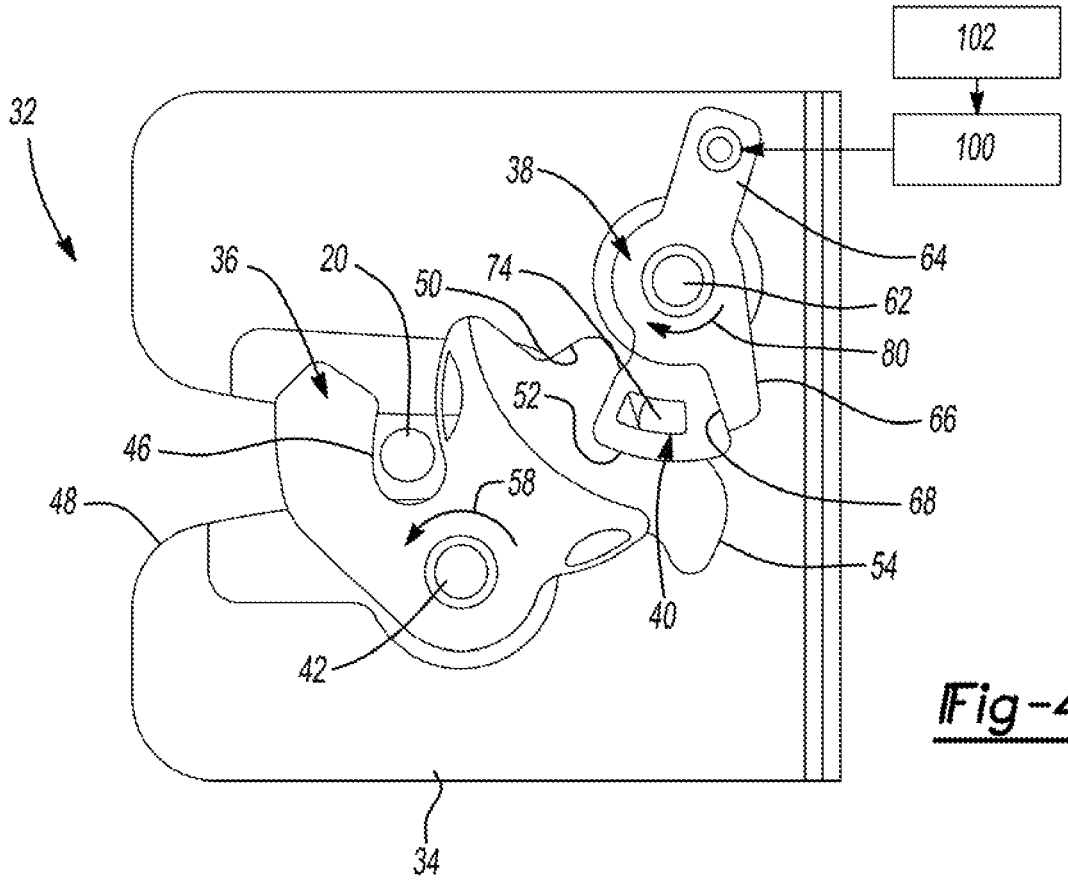
FIG. 4B is a similar plan view illustrating the latch mechanism in an initial or secondary closed state.
Figure 4C:
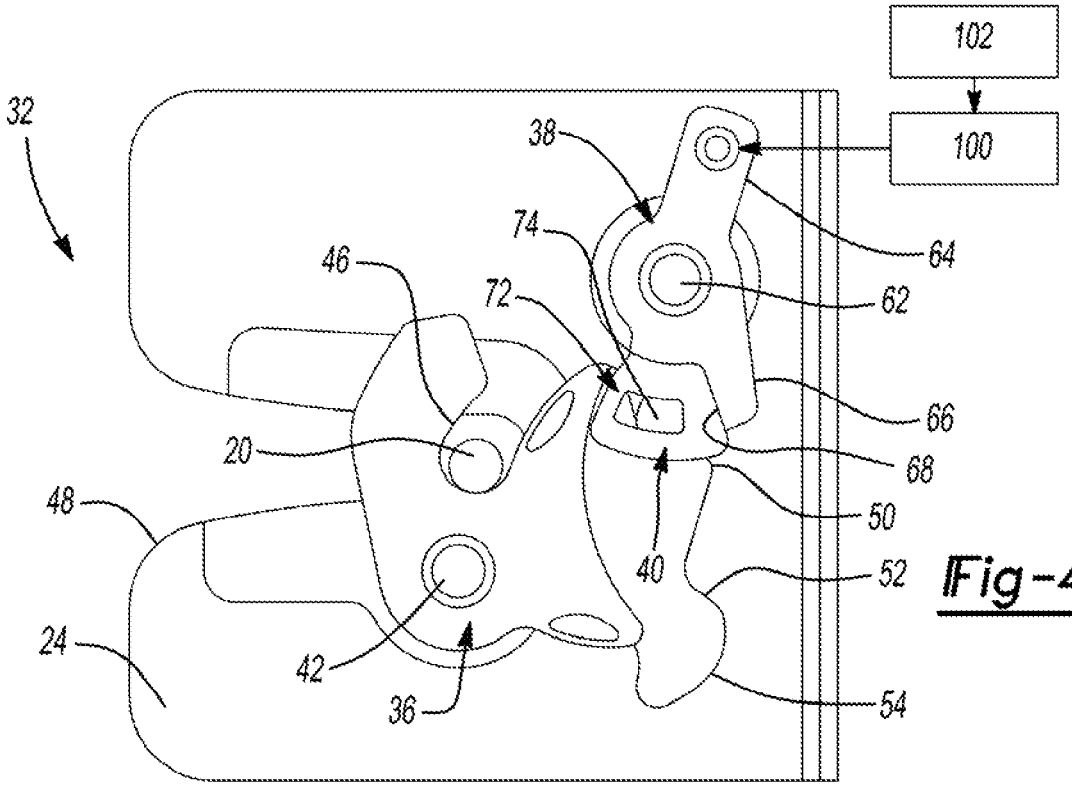
FIG. 4C is yet another plan view illustrating the latch mechanism in a final or primary closed state.
Figure 4D:
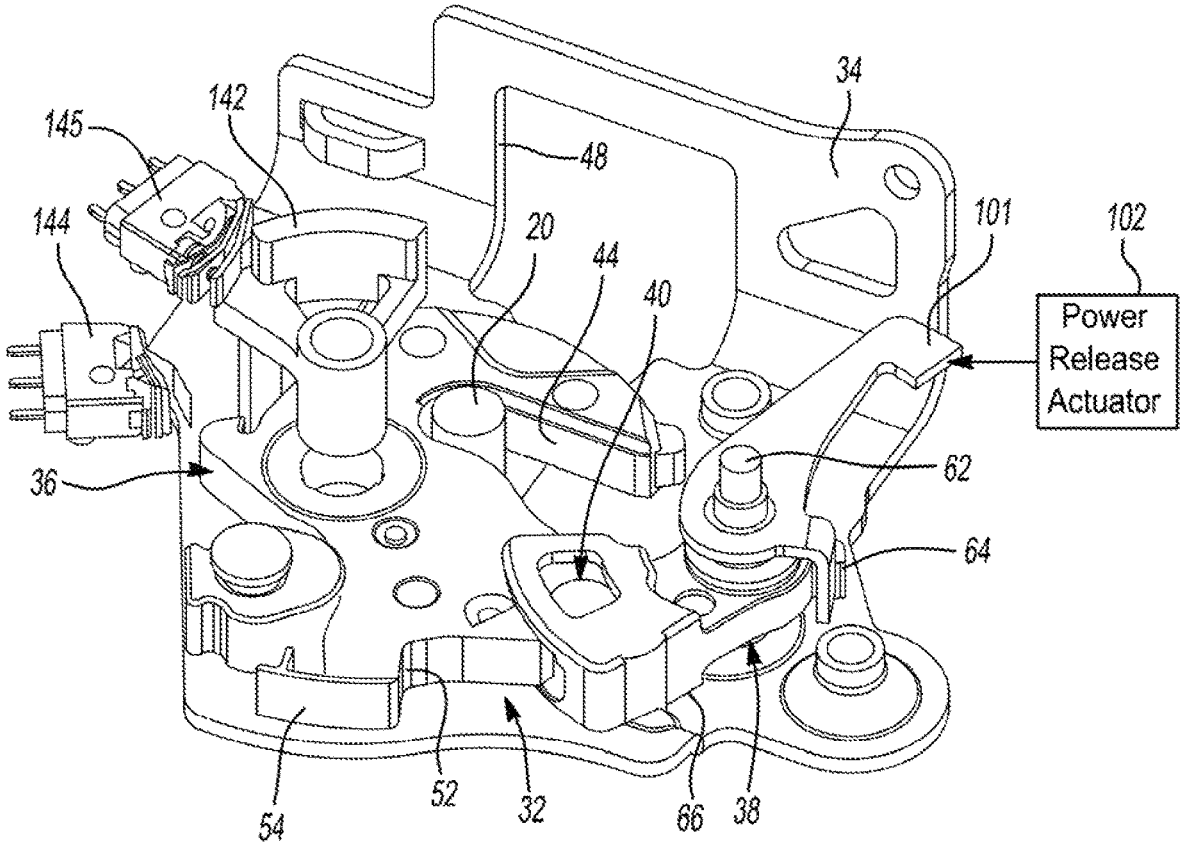
FIG. 4D is an isometric view of the latch mechanism in its primary closed state.

As shown in FIG. 4A, pawl 38 is held in its ratchet releasing position when ratchet 36 is located in its striker release position due to engagement of ball 74 with pawl engagement surface 68 and with edge surface 54 on ratchet 36, whereby a released operating state for latch mechanism 32 is established. As shown in FIG. 4B, ball 74 engages pawl engagement surface 68 on pawl 38 and secondary latch notch 52 on ratchet 36 so as to cause pawl 38, when located in its ratchet holding position, to hold ratchet 36 in its secondary striker capture position. In this orientation, striker 20 is retained between ratchet guide channel 46 and fishmouth slot 48 in latch plate 34 to hold door 16 in a partially-closed position and establish a secondary closed state for latch mechanism 32. Finally, FIGS. 4C and 4D illustrate pawl 38 located in its ratchet holding position with ball 74 engaging pawl engagement surface 68 on pawl 38 and primary latch notch 50 on ratchet 36 such that pawl 38 holds ratchet 36 in its primary striker capture position so as to hold door 16 in its fully-closed position and establish a primary closed operating state for latch mechanism 32.

A latch release mechanism 100 is shown schematically to be connected to first pawl leg segment 64 of pawl 36. Latch release mechanism 100 may include a release lever 101 (FIG. 4D) that is moveable between non-actuated and actuated positions to cause corresponding movement of pawl 38 between its ratchet holding and ratchet releasing positions. In addition, a power release actuator 102 is shown schematically connected to release lever 101 of latch release mechanism 100. Actuation of power release actuator 102 causes release lever 101 to move pawl 38 from its ratchet holding position into its ratchet releasing position. Power release actuator 102 is preferably an electric motor-driven arrangement. A ratchet switch lever 142 is mounted to ratchet 36 and works in cooperation with a ratchet release sensor 144 to provide a "door open" signal when ratchet 36 is located in its striker release position and a secondary latched sensor 145 to provide a "door ajar" signal when ratchet 36 is located in its secondary striker capture position. As is well known, these signals are used by a latch controller unit (ECU) to control operation of power release actuator 102.

Figure 5A:
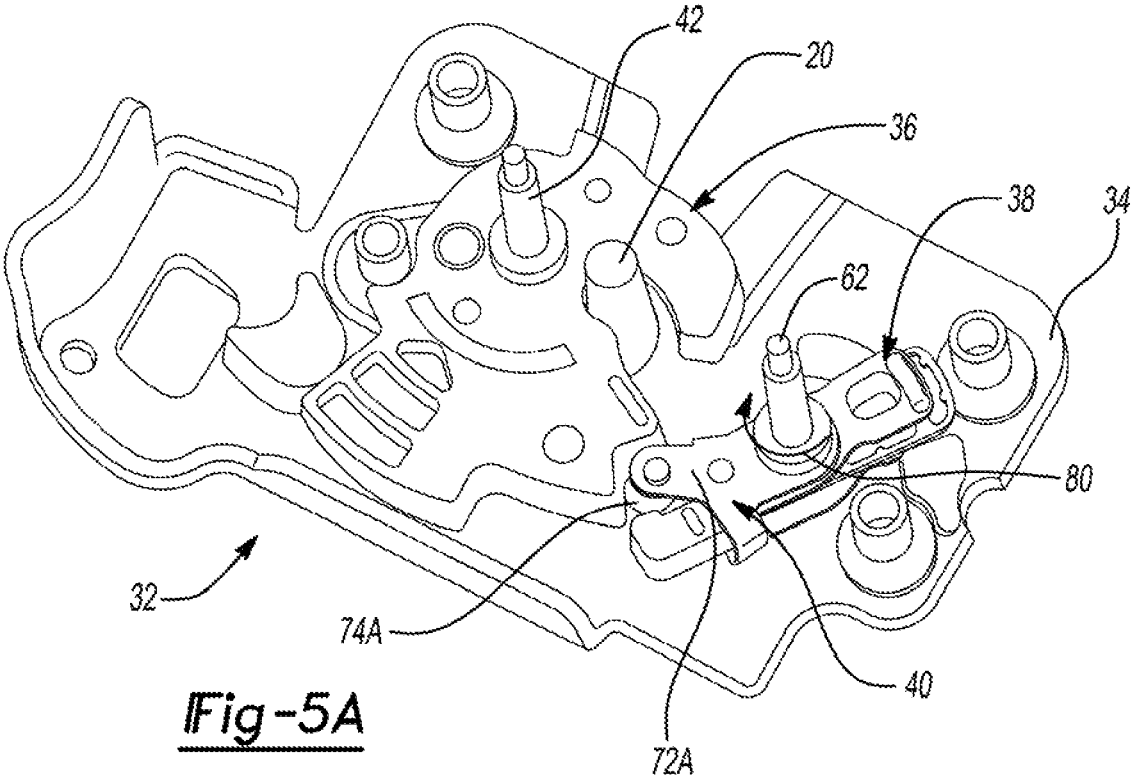
FIGS. 5A and 5B illustrate an alternative version of a roller-type latch mechanism operating in its primary closed state.
Figure 5B:
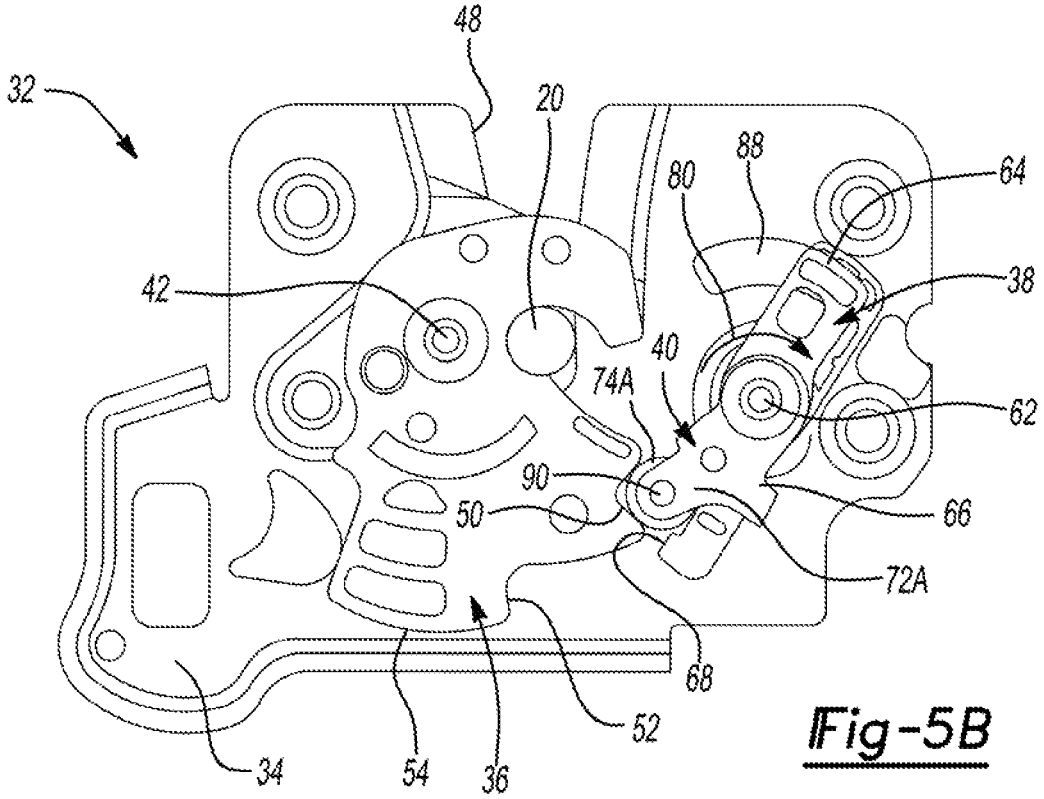
Figure 6A:
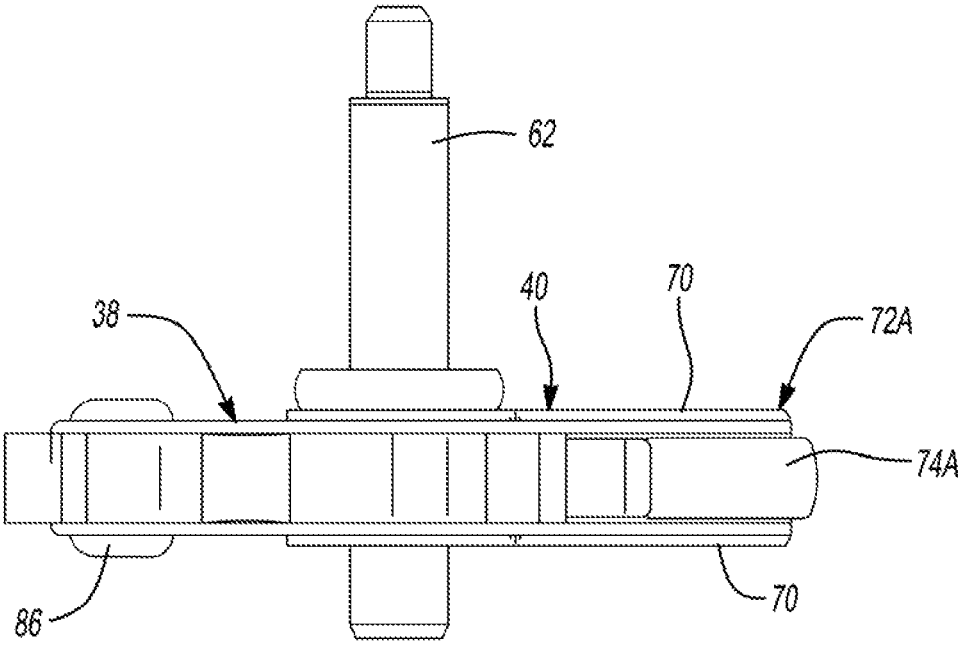
FIGS. 6A and 6B illustrate a roller engagement device associated with the pawl of the alternative latch mechanism shown in FIGS. 5A and 5B in greater detail.
Figure 6B:
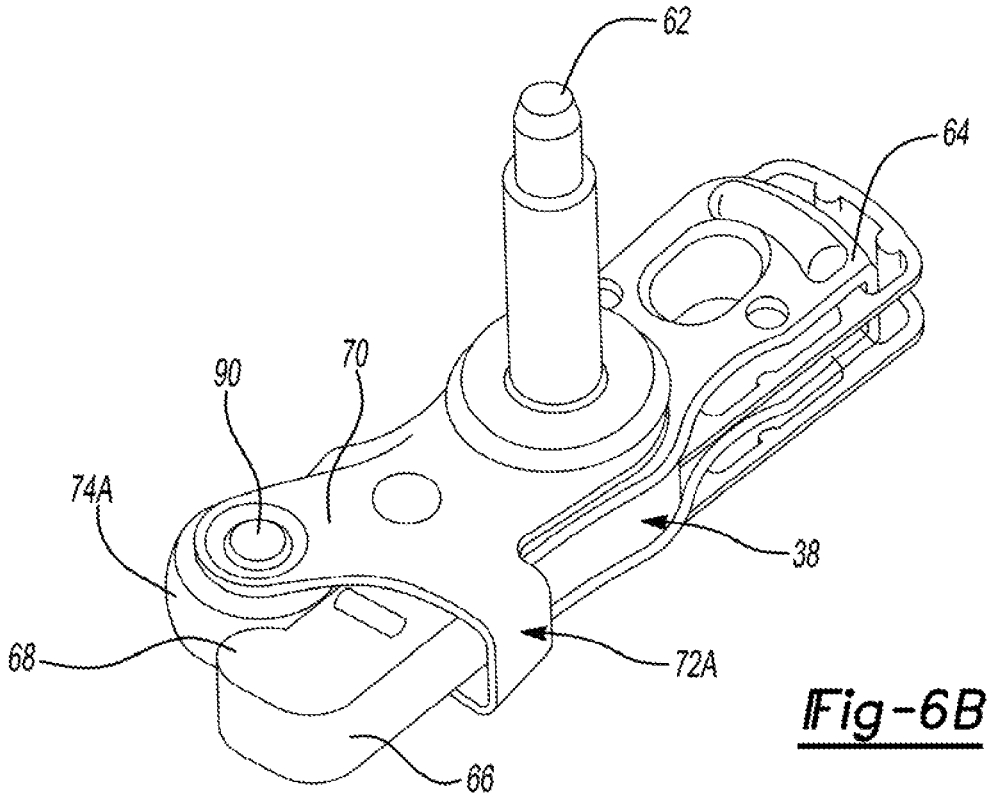

FIGS. 5A and 5B are provided to more clearly illustrate the engagement of a roller 74A associated with engagement device 40 between pawl surface 68 on pawl 38 and primary latch notch 50 on ratchet 36 when ratchet 36 is held in its primary striker capture position by pawl 38 being positioned in its ratchet holding position. A lug 86 on first pawl leg segment 64 of pawl 38 is shown positioned within an arcuate guide slot 88 formed in latch plate 34 to provide guided pivotal movement of pawl 38. Lug 86 may engage an actuation mechanism, such as power release actuator 102 provided on an opposite side of latch plate 34 in accordance with an illustrative embodiment. FIGS. 6A and 6B better illustrate an alternative construction of pawl 38 and roller-type engagement unit 40. Note that in FIGS. 2-4, the roller member was a spherical ball 74 retained within cage 72. However, FIGS. 5 and 6 illustrate the roller member being a follower 74A mounted on a pivot post 90 extending from cage 72A.

Figure 7A:
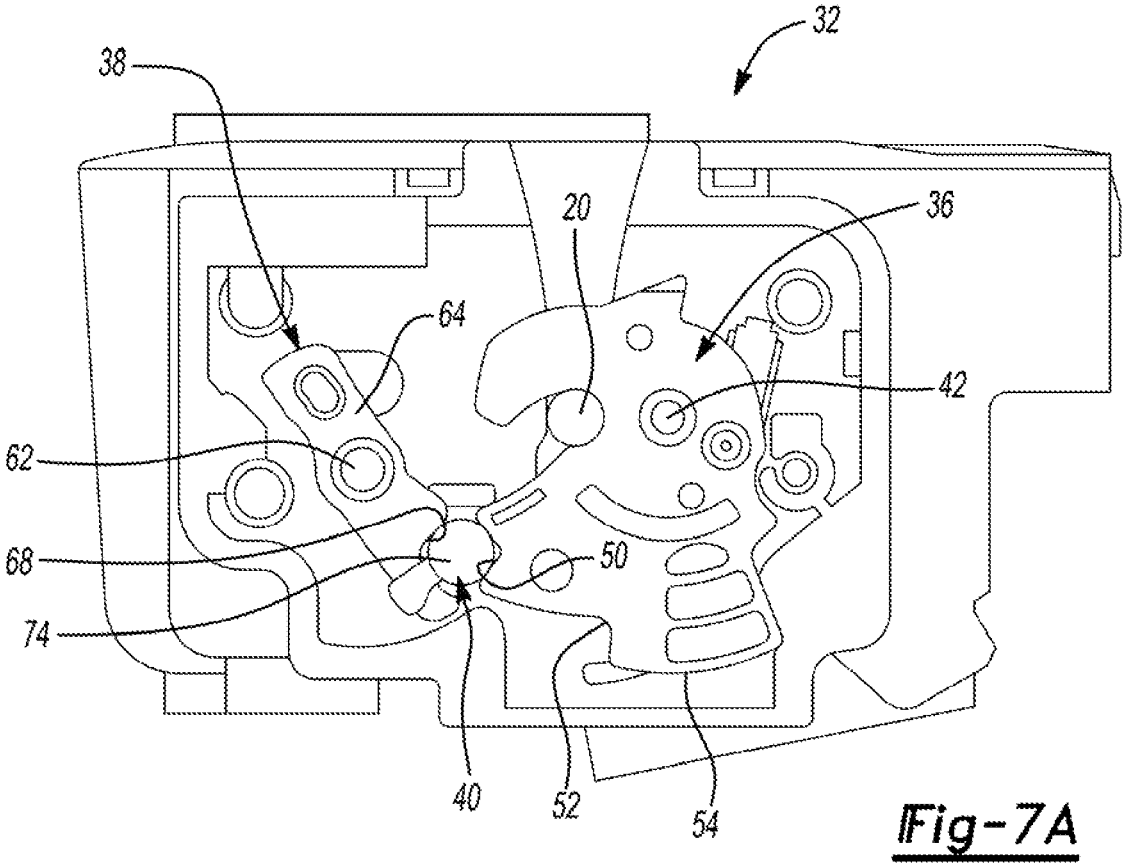
FIGS. 7A through 7H are a series of sequential plan views illustrating shifting of a roller-type latch mechanism from its primary closed state into its released state.
Figure 7B:
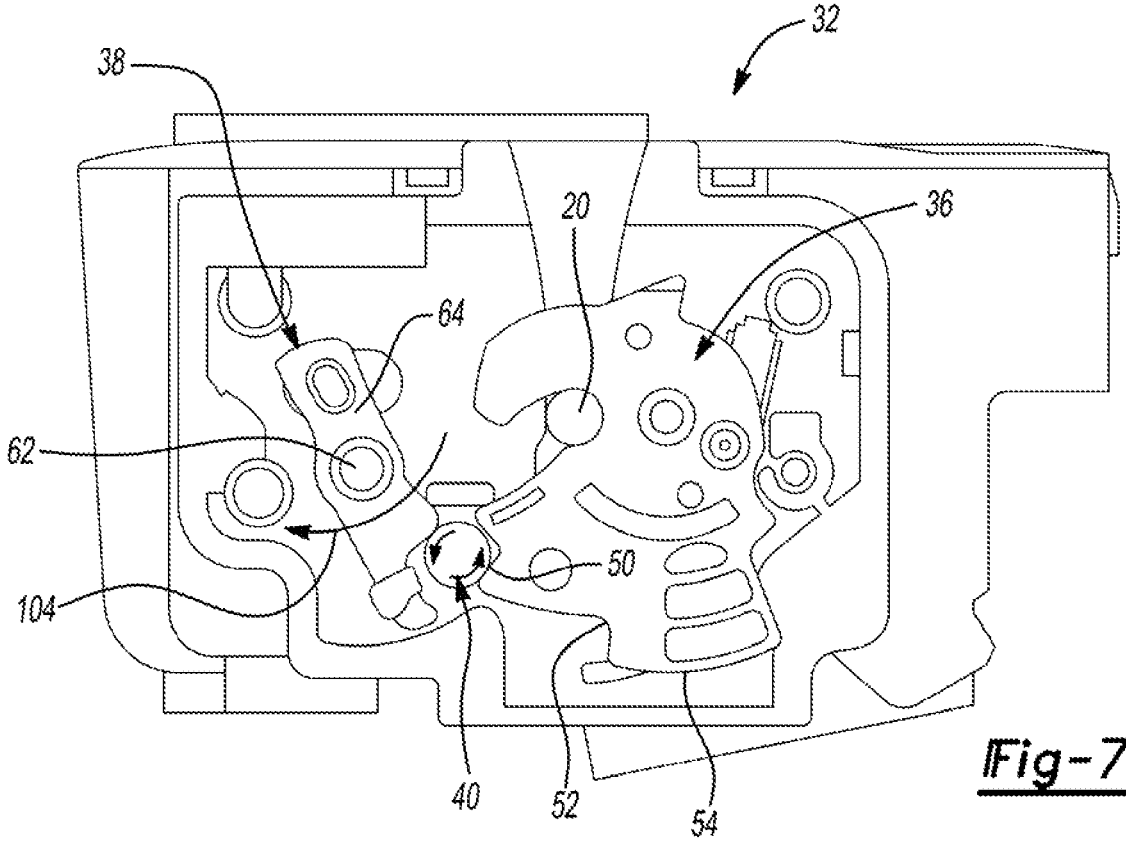
Figure 7C:
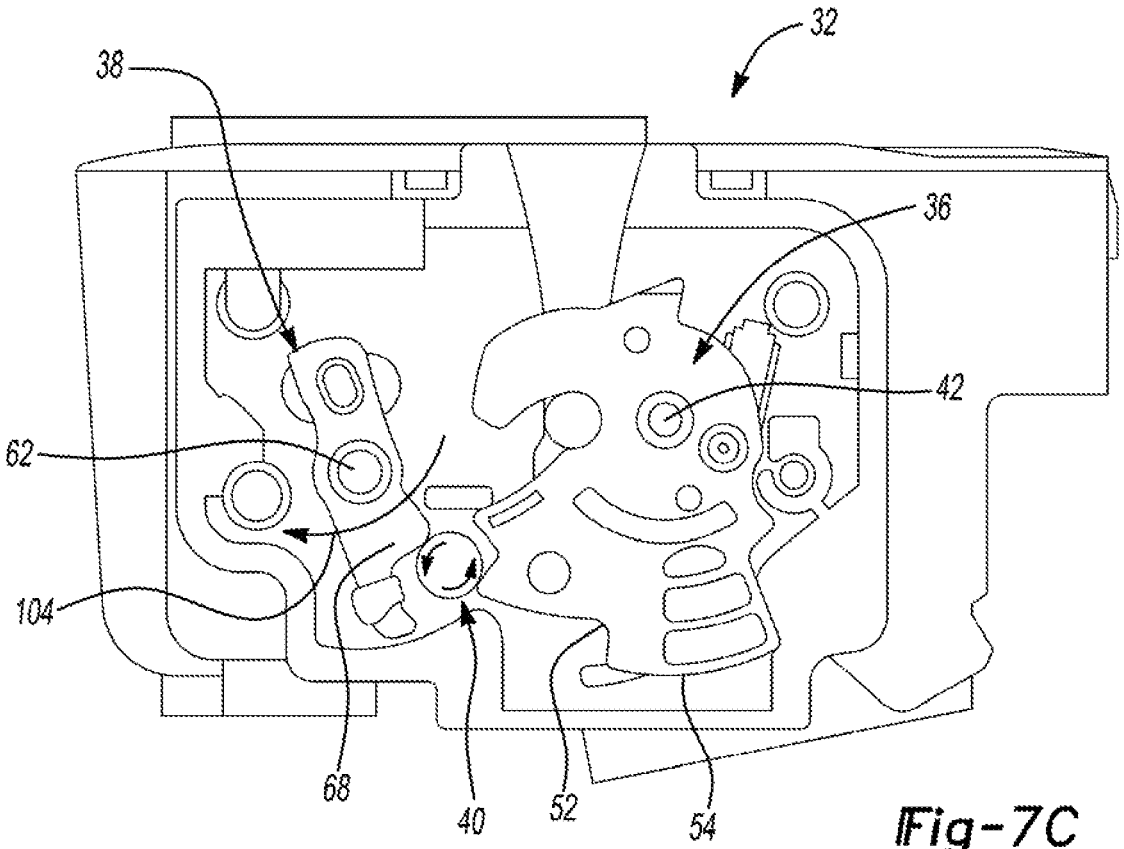
Figure 7D:
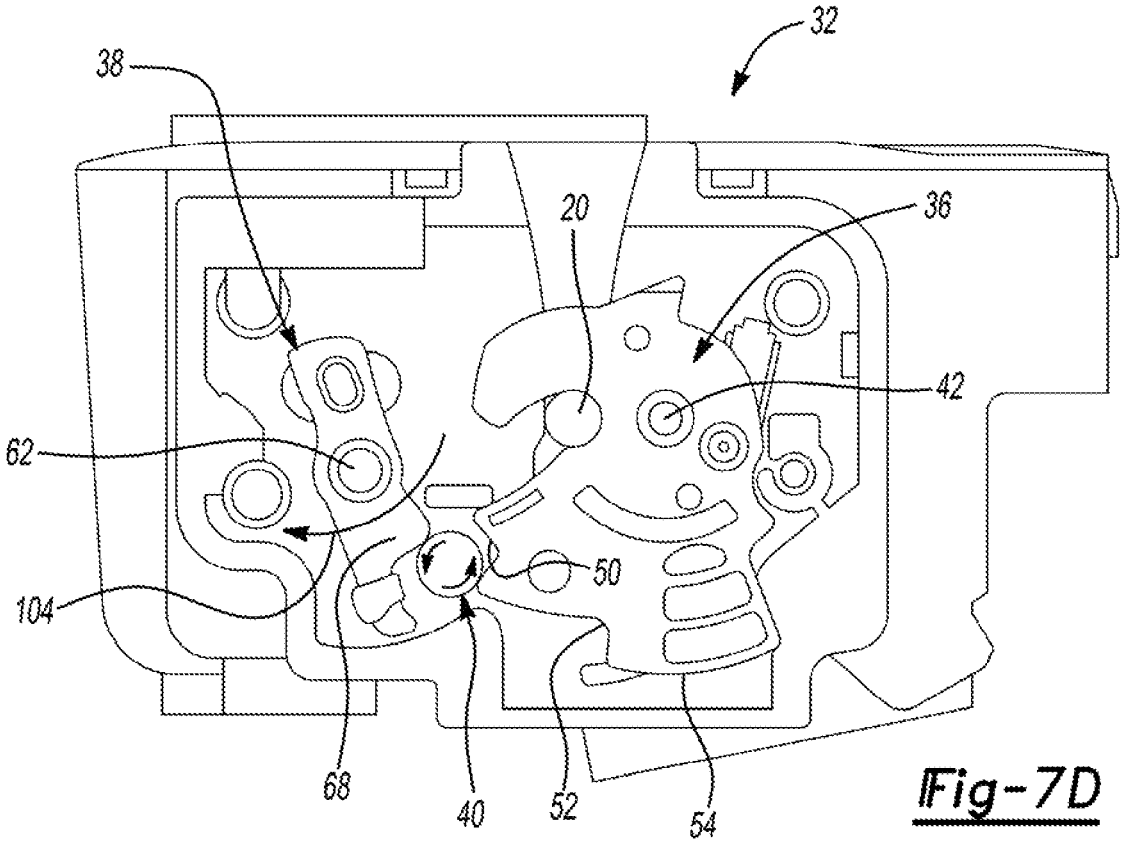
Figure 7E:
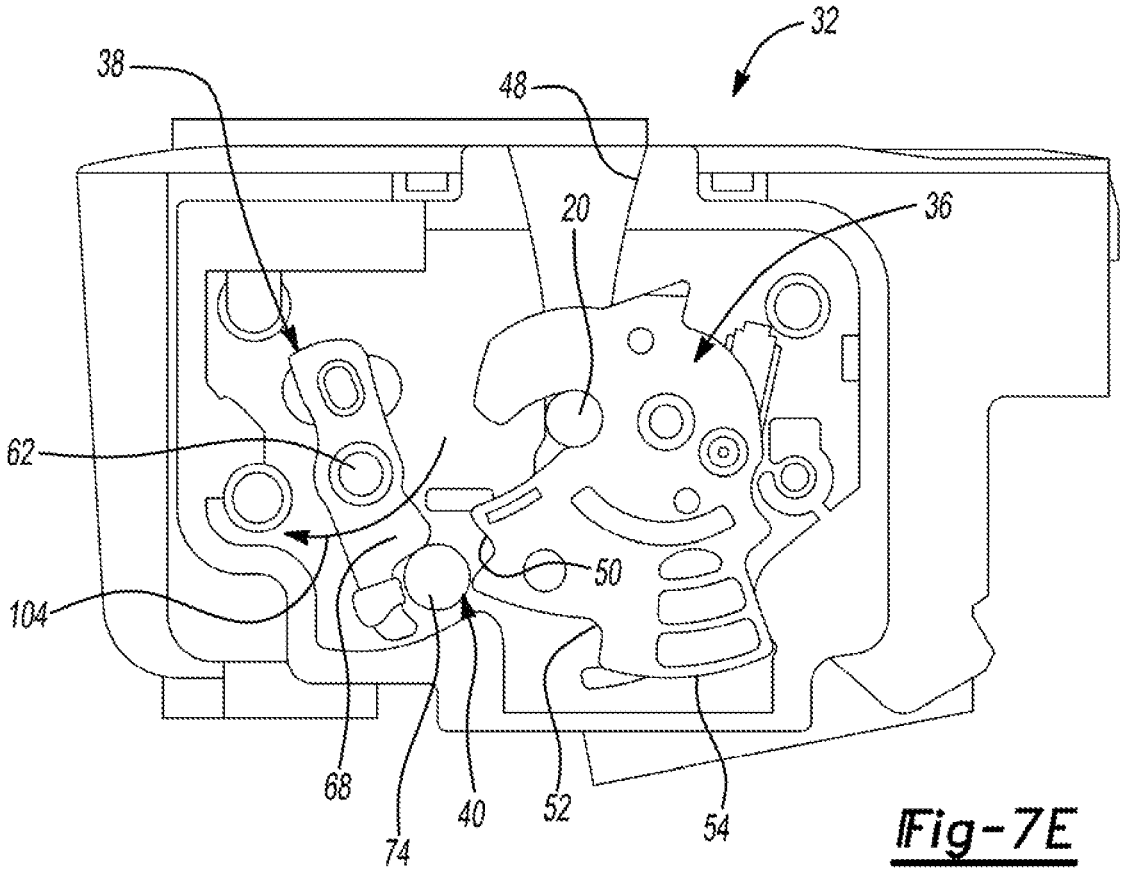
Figure 7F:
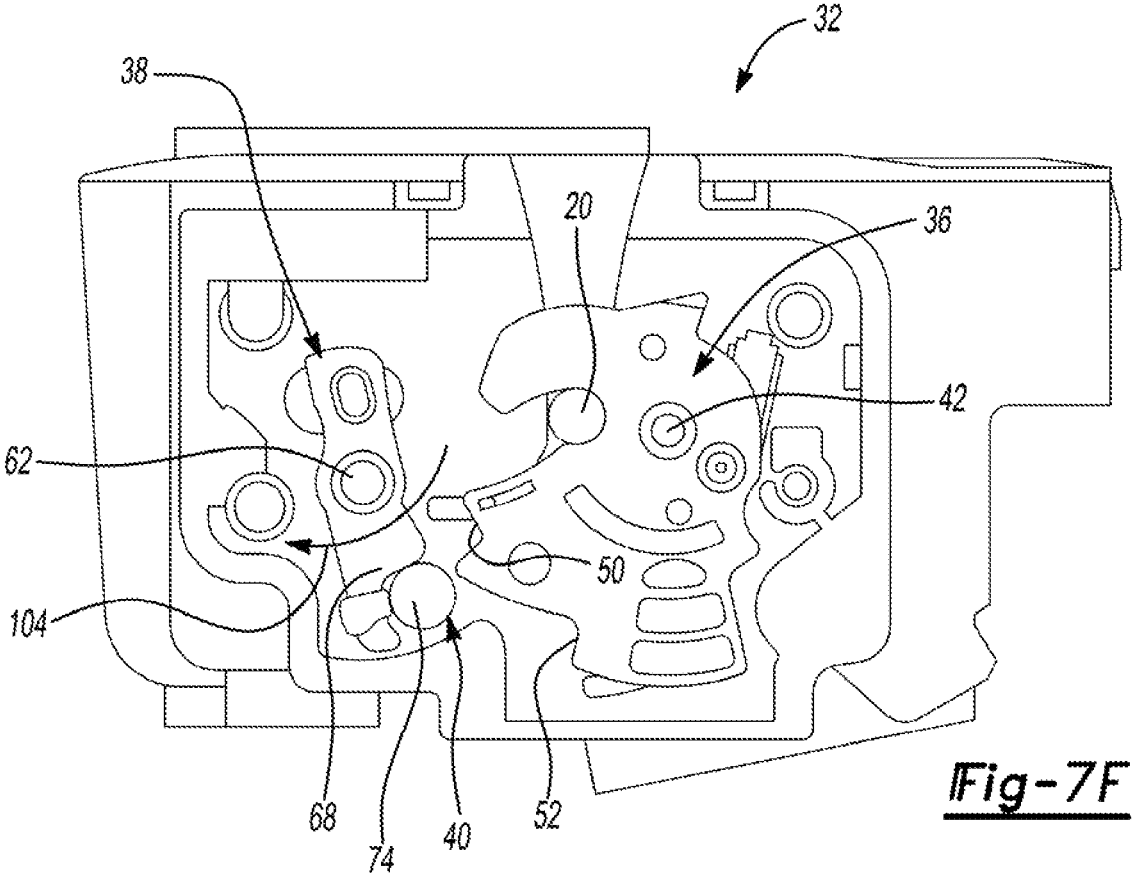
Figure 7G:
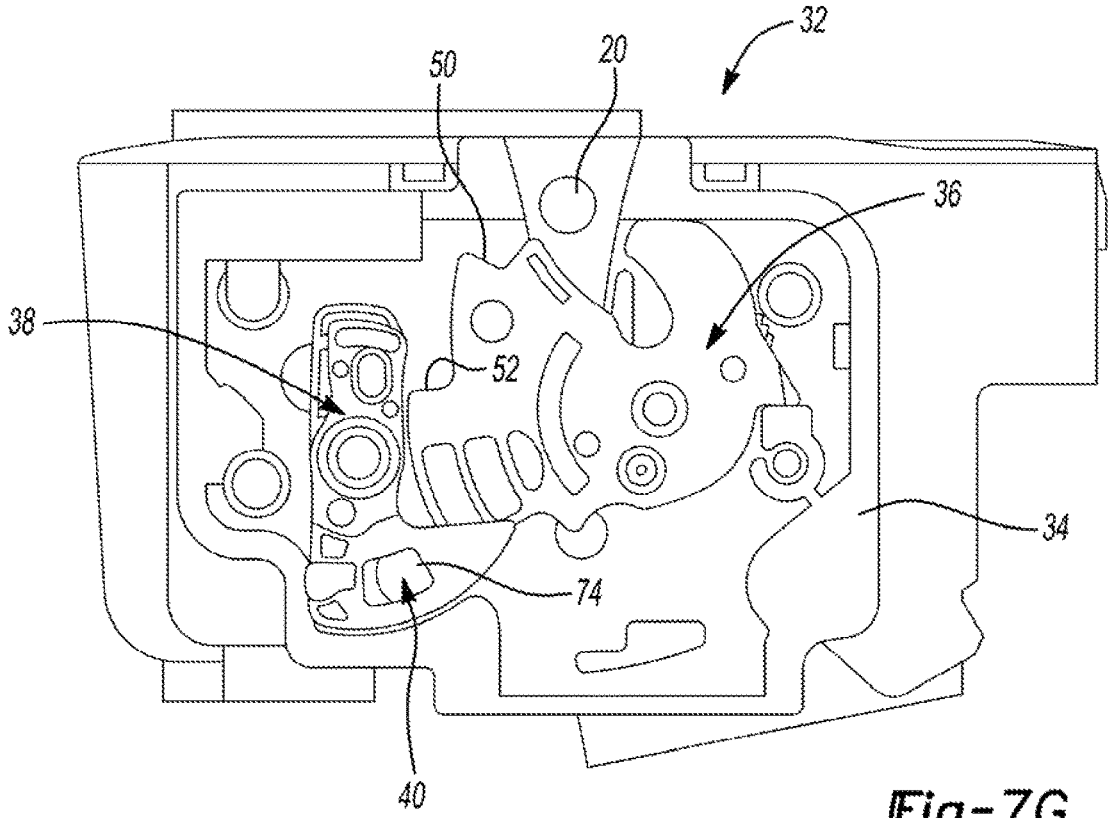
Figure 7H:
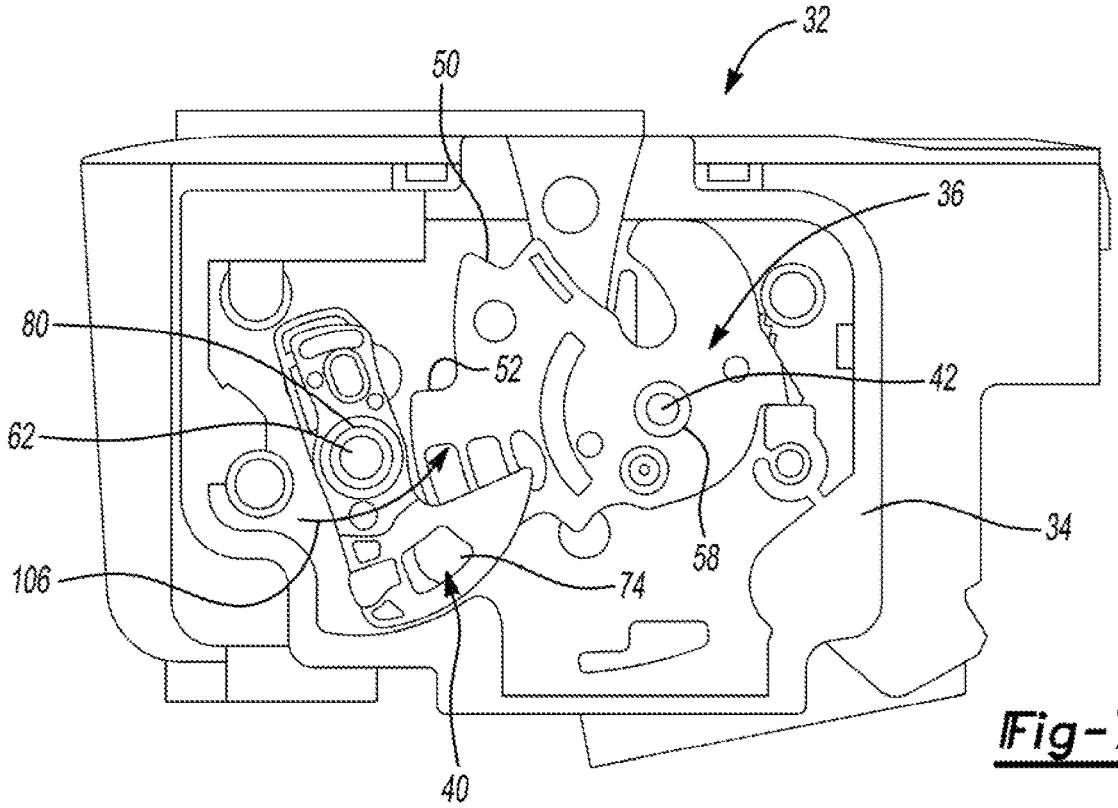

Referring now to FIGS. 7A through 7H, a sequential series of views are provided of latch mechanism 32 as it is shifted from its primary closed state (FIG. 7A) into its released state (FIG. 7H) in response to actuation of latch release mechanism 100 causing pawl 38 to pivot from its ratchet holding position into its ratchet releasing position. Arrow 104 (FIGS. 7B-7G) illustrates the force applied by latch release mechanism 100 to move pawl 38 in a ratchet releasing direction from its ratchet holding position into its ratchet releasing position. FIG. 7H illustrates, via arrow 106, rotation of pawl 38 in a ratchet engaging direction back toward its ratchet holding position due to the biasing of pawl spring 80 such that ball 74 engages cam edge 54 of ratchet 36 upon release of latch release mechanism 100.

Figure 8A:
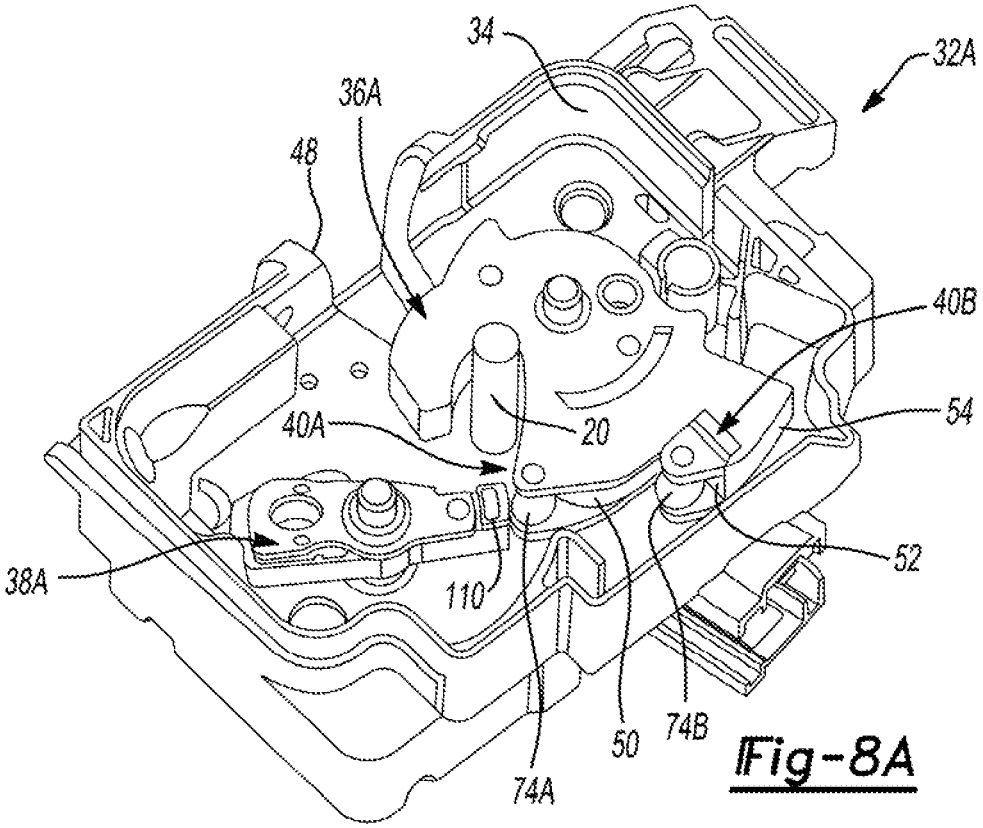
FIGS. 8A and 8B are views illustrating another yet alternative embodiment of the roller-type latch mechanism configured for use with the closure latch assembly.
Figure 8B:
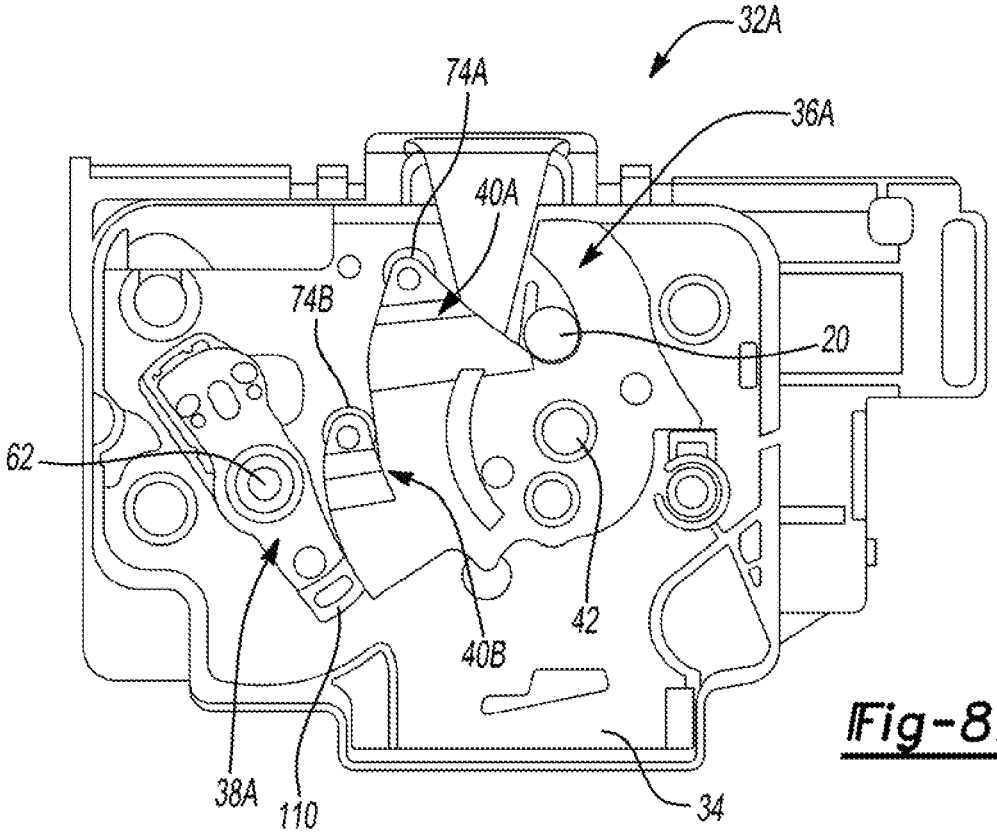

Referring now to FIGS. 8A and 8B, an alternative roller-type latch mechanism 32A is shown to have a primary roller-type engagement device 40A mounted on ratchet 36A adjacent to primary latch notch 50, a secondary roller-type engagement device 40B mounted on ratchet 36A adjacent to secondary latch notch 52, and a pawl 38A with an engagement end 110 adapted to latchingly engage roller 74A (associated with primary engagement device 40A) when ratchet 36A is located in its primary striker capture position and to latchingly engage roller 74B (associated with secondary engagement device 40B) when ratchet 36A is located in its secondary striker capture position. FIG. 8A illustrates pawl 38A located in its ratchet holding position while FIG. 8B illustrates pawl 38A located in its ratchet releasing position.

Figure 9:
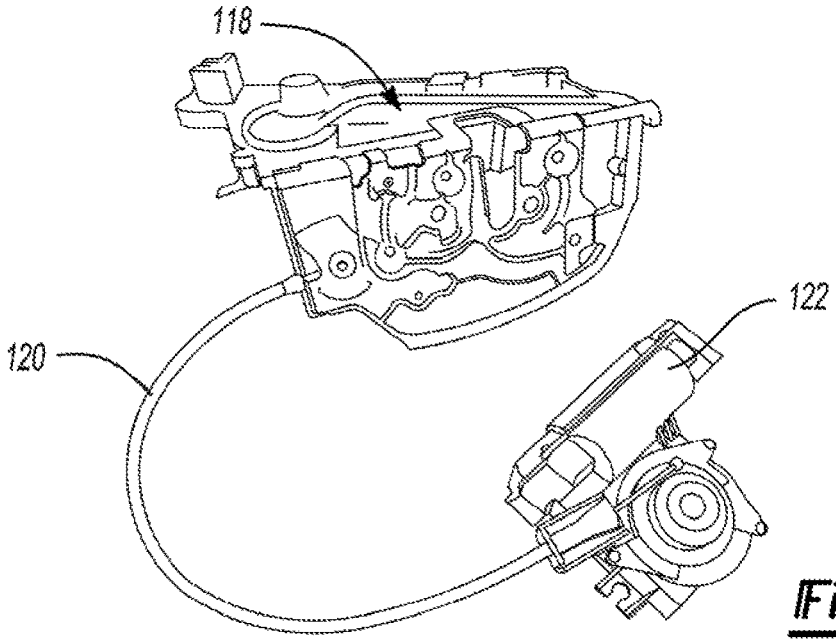
FIG. 9 is a isometric view of a closure latch assembly constructed according to the present disclosure to include a latch cinch mechanism which is shown interconnected to a power-operated cinch actuator via a cinch cable assembly.
Figure 10:
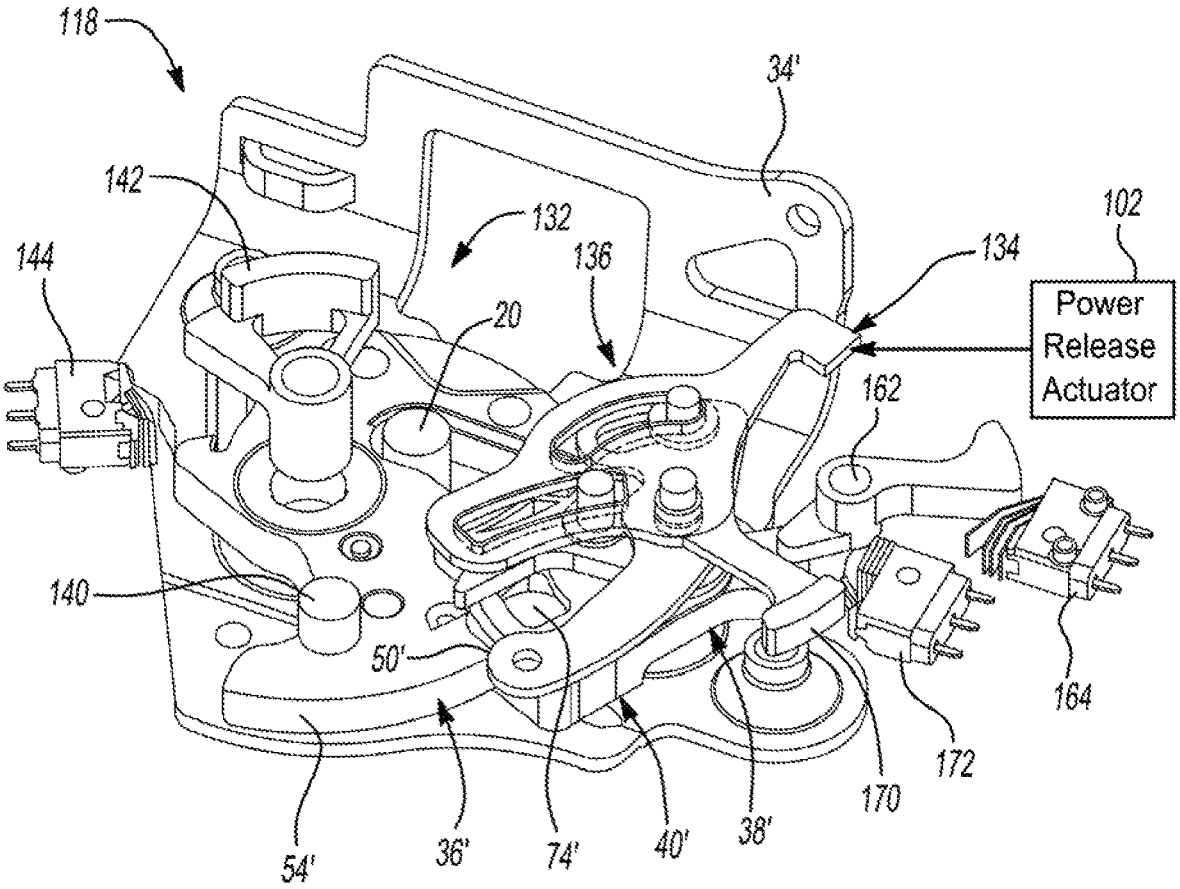
FIG. 10 is an isometric view of a strength module associated with the closure latch assembly shown in FIG. 9 illustrating a roller-type ratchet/pawl latch mechanism, a latch release mechanism, and a latch cinch mechanism operably arranged for providing unique operational functionality according to the present disclosure.
Figure 9A:
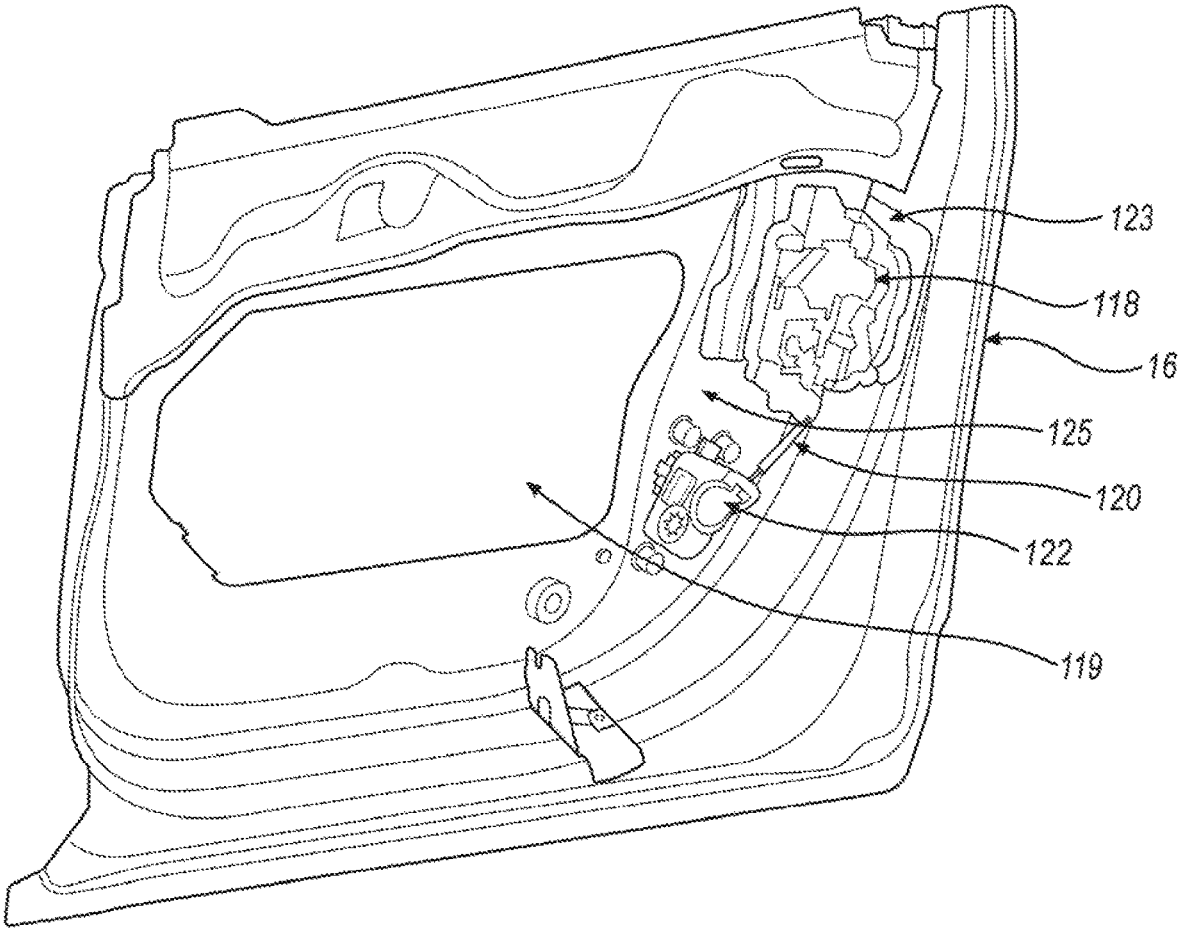
FIG. 9A is an isometric view of the closure latch assembly and the latch cinch mechanism which is shown interconnected to a power-operated cinch actuator via a cinch cable assembly as illustratively installed within an inner cavity of a vehicle door.

The roller-type single ratchet/pawl latch mechanisms disclosed above each provide reduced latch release efforts required to move the pawl from its ratchet holding position to its ratchet releasing position due to rolling (i.e. point-type) engagement compared to the otherwise conventional sliding friction engagement associated with non-roller type latch mechanisms. However, the requirement to provide both primary latching (door fully-closed) and secondary latching (door partially-closed) functionality requires increased packaging to accommodate the pawl travel and provide adequate latching surfaces on the ratchet. In addition, it would be desirable to provide a more compact configuration capable of also providing a power cinching feature. In this regard, FIG. 9 is a isometric view of a non-limiting sample embodiment of a closure latch assembly 118 operably interconnected via a cinch actuation mechanism 120, shown as a cinch cable assembly 120, to a power-operated cinch actuator 122. FIG. 9A illustrates the closure latch assembly 118 operably interconnected to a cinch cable assembly 120 which is operate to be driven e.g. pulled and/or pushed by a power cinch actuator 122. The closure latch assembly 118 and the power cinch actuator 122 are shown as being both installed e.g. mounted to an inner door shut face surface 123 and an inner panel 125, respectively, of door 16, within an inner cavity 119 of vehicle door 16, the inner cavity 119 defined by the inner panel 125 and an outer panel (not shown). FIG. 10 is an isometric view of a latch mechanism 132, a latch release mechanism 134, and a latch cinch mechanism 136 associated with a strength module incorporated in closure latch assembly 118 and which will be detailed hereinafter. FIG. 10 illustrates a revised version of the strength module shown in FIG. 4D and which is now equipped with enhanced functionality provided by the present disclosure. Specifically, latch cinch mechanism 136 is configured to hold latch mechanism 132 in its secondary closing state and to subsequently cause latch mechanism 132 to be transitioned from its secondary closing state to its primary closing state.

Figure 11:
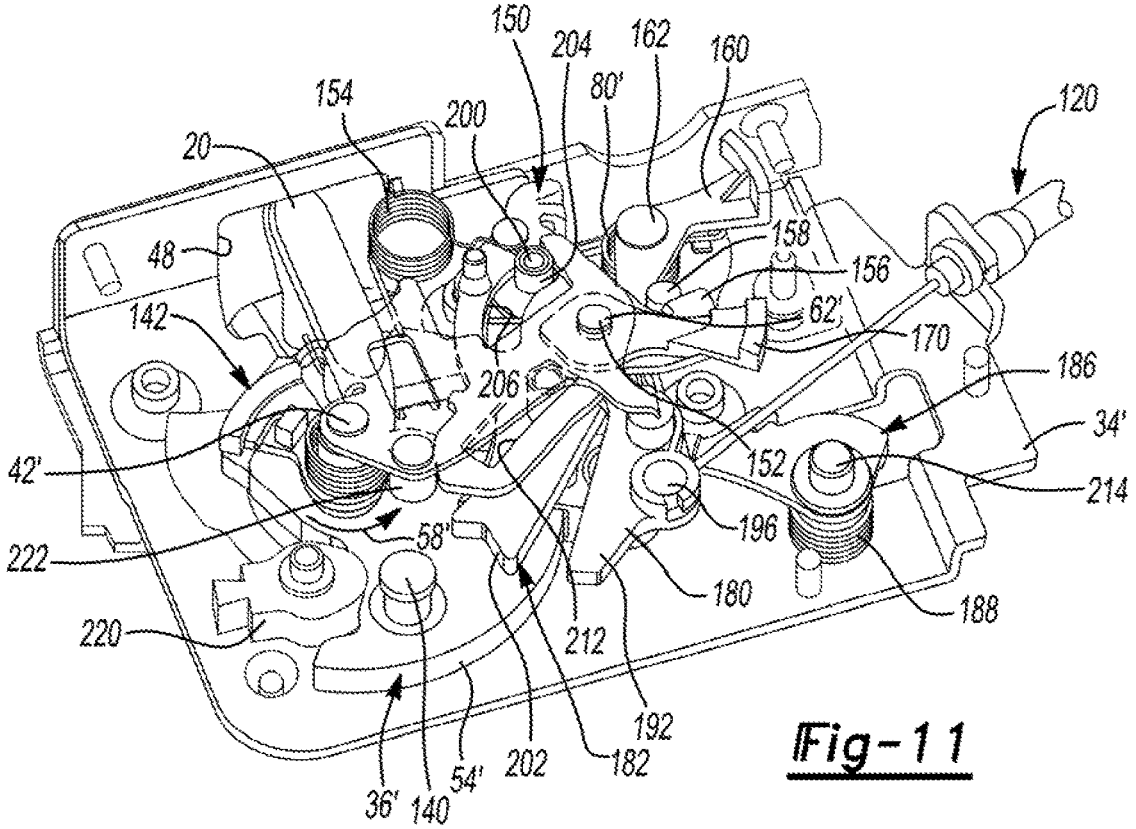
FIGS. 11 and 12 are additional isometric views of the strength module of FIG. 10 showing additional components and various operative connections therebetween.
Figure 12:
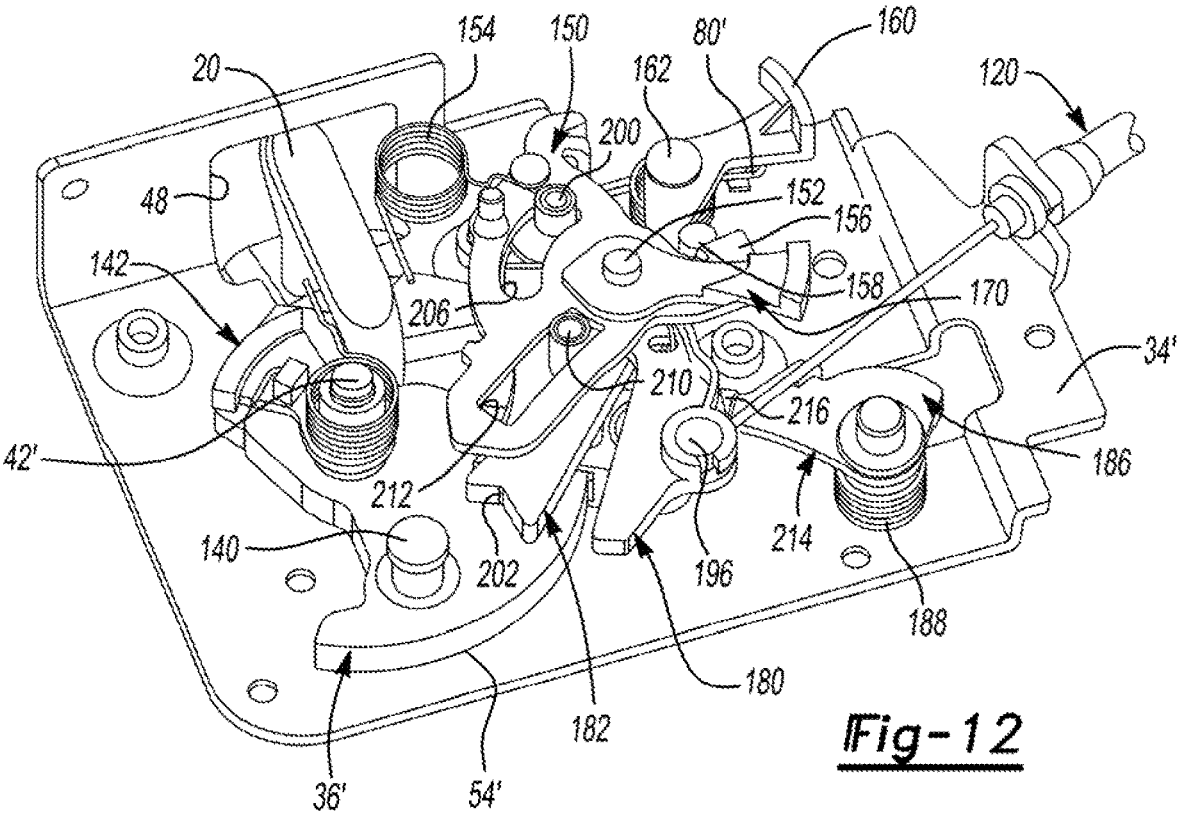

Referring initially to FIGS. 10-12, latch mechanism 132 is generally shown to include a configuration similar to latch mechanism 32 of FIGS. 2-4. To this end, latch mechanism 132 includes a ratchet 36' supported from a frame plate 34' for rotational movement about a ratchet pivot post 42', a pawl 38' supported from frame plate 34' for pivotal movement about a pawl pivot post 62', and a roller-type engagement device 40' having a cage 72' secured to pawl 38' and ball bearing 74' retained within cage 72'. However, in this particular embodiment, ratchet 36' only includes a single latch feature, configured as a primary latch notch 50', and an elongated edge profile 54'. As will be detailed, latch cinch mechanism 136 is configured to engage a ratchet engagement feature or member, such as a ratchet post 140, extending from ratchet 36' when ratchet 36' is moved by striker 20 from its striker release position into its secondary striker capture position and to mechanically hold ratchet 36' in its secondary striker capture position while pawl 38' is maintained in its ratchet releasing position with ball bearing 74' engaging elongated cam profile 54'. Thus the secondary latch notch has been eliminated, thus simplifying the ratchet 36' profile, since pawl 38' is no longer used to hold ratchet 36' in its secondary striker capture position. Ratchet switch lever 142 is mounted to ratchet 36' about ratchet pivot post 42' and works in cooperation with ratchet position sensor 144 to provide a "door open" signal when ratchet 36' moves to its striker release position. As is well known, the door open signal is used by the latch controller unit (ECU) to control initial actuation and subsequent resetting of power release actuator 102 and latch release mechanism 134. Ratchet biasing member 58' is again indicated by a directional arrow to illustrate normal biasing of ratchet 36' toward its striker release position.

As before, ratchet 36' is still rotatable between its three distinct positions including its striker release position, its secondary striker capture position, and its primary striker capture position. Likewise, pawl 38' is still pivotal about pawl pivot post 62' between its ratchet holding position and its ratchet releasing position. In this embodiment, however, elongated cam profile 54' on ratchet 36' holds pawl 38' in its ratchet releasing position when ratchet 36' is located in both of its striker release position and its secondary striker capture position. As such, pawl 38' is only permitted to move into its ratchet holding position when ratchet 36' is moved into its primary striker capture position whereat ball bearing 74' engages surface 68' on pawl 38' and primary latch notch 50' on ratchet 36'. A pawl biasing member 80' is provided for normally biasing pawl 36' toward its ratchet holding position.

Latch release mechanism 134 includes a release lever 150 supported about a release lever pivot post 152 for movement between a non-actuated position and an actuated position, and a release lever biasing spring 154 operable to normally bias release lever 150 toward its non-actuated position. Release lever pivot post 152 is shown in this non-limiting embodiment to be aligned with and/or integrally associated with pawl pivot post 62'. A release lever lug 156 formed on release lever 150 engages a pawl lug 158 formed on first pawl leg segment 64' of pawl 36'. As such, movement of release lever 150 from its non-actuated position into its actuated position causes pawl 38' to move from its ratchet holding position to its ratchet releasing position. As before, a power release actuator 102 (schematically shown in FIG. 10) is provided for moving release lever 150 from is non-actuated position into its actuated position when the ECU is signaled to shift latch mechanism 132 from one of its closed operating states into its released operating state. A pawl switch lever 160 is pivotal about pivot post 162 and is used in conjunction with a pawl position sensor 164 (FIG. 10) to detect when pawl 38' is located in its ratchet holding position which is also indicative of ratchet 36' being located in its primary striker capture position so as to indicate door 16 being located in its fully-closed position. Pawl switch lever 160 has a leg portion 166 (FIG. 13) engaging pawl lug 158 such that movement of pawl switch lever 160 in response to movement of pawl 38' to its ratchet holding position actuates pawl position sensor 164.

Latch cinch mechanism 136 is operably connected via cinch cable assembly 120 to power cinch actuator 122 (FIG. 9) for driving ratchet 36' from its secondary striker capture position into its primary striker capture position. A cinch switch lever 170 associated with latch cinch mechanism 136 is arranged to actuate a cinch sensor 172 (FIG. 10) when ratchet 36' is located in its secondary striker capture position so as to cause the ECU to actuate power cinch actuator 122 and initiate the power cinching function. Note also that pawl switch lever 160 is used to recognize when ratchet 36' is located in its primary striker capture position to cause the ECU to de-actuate power cinch actuator 122 and complete the power cinching function.

Generally speaking, latch cinch mechanism 136 includes, in this non-limiting embodiment, a cinch lever 180, a cinch link 182, a cinch link biasing member 184 shown in the figures as a cinch link spring 184, an auxiliary cinch lever 186, and an auxiliary cinch lever spring 188. Cinch lever 180 is mounted for pivotal movement about a pivot axis, such as release lever pivot post 152, and is configured to include a first cinch lever leg 190 and a second cinch lever leg 192 disposed on opposite sides of a cinch lever pivot segment 193. Illustratively, the release lever 150 and cinch lever 180 are shown positioned adjacent to the ratchet 36' within distinct planes in an overlapping compact configuration. A lost motion slot 194 is formed in first cinch lever leg 190. The lost motion slot 194 is dimensioned to allow pretravel for the cinch lever 180 that is attached by cinch cable 120 to the power-operated cinch actuator 122. The dimensional and positional tolerances of cinch cable 120, for example a Bowden cable length tolerance, as well as the power-operated cinch actuator 122 and latch Bowden cable attachment tolerances are compensated by the lost motion slot 194 to avoid the cinch link 182 from being preloaded by the cinch lever 180 which may modify the nominal latched secondary position, i.e. the rotational position of the ratchet 36' at which the ratchet post 140 moves into engagement with a side edge surface of cinch link 182, as will be described in more detail herein below.

Figure 13:
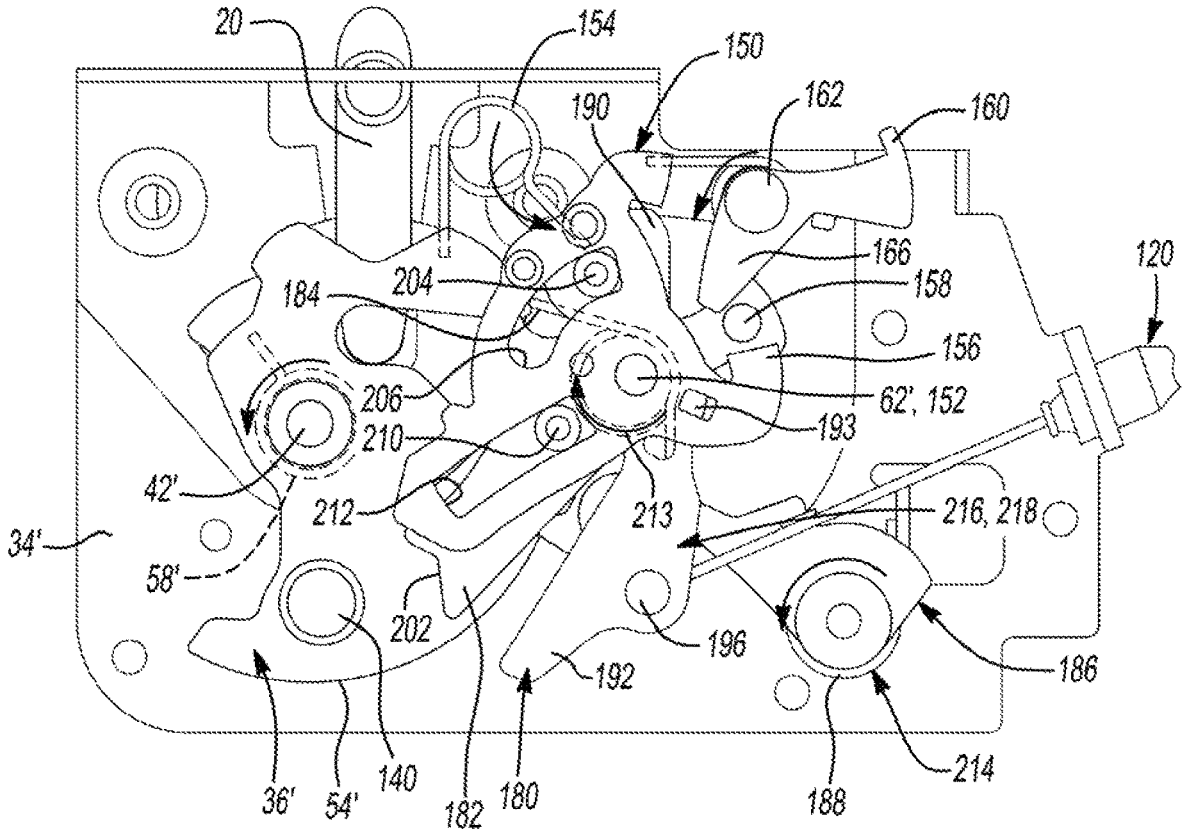
FIGS. 13 through 17 are views of the strength module shown in FIGS. 10-12 now illustrating the orientation and positioning of the various components with the latch mechanism operating in a primary closed state, the latch release mechanism operating in a non-actuated state, and the latch cinch mechanism operating in a rest state.
Figure 14:
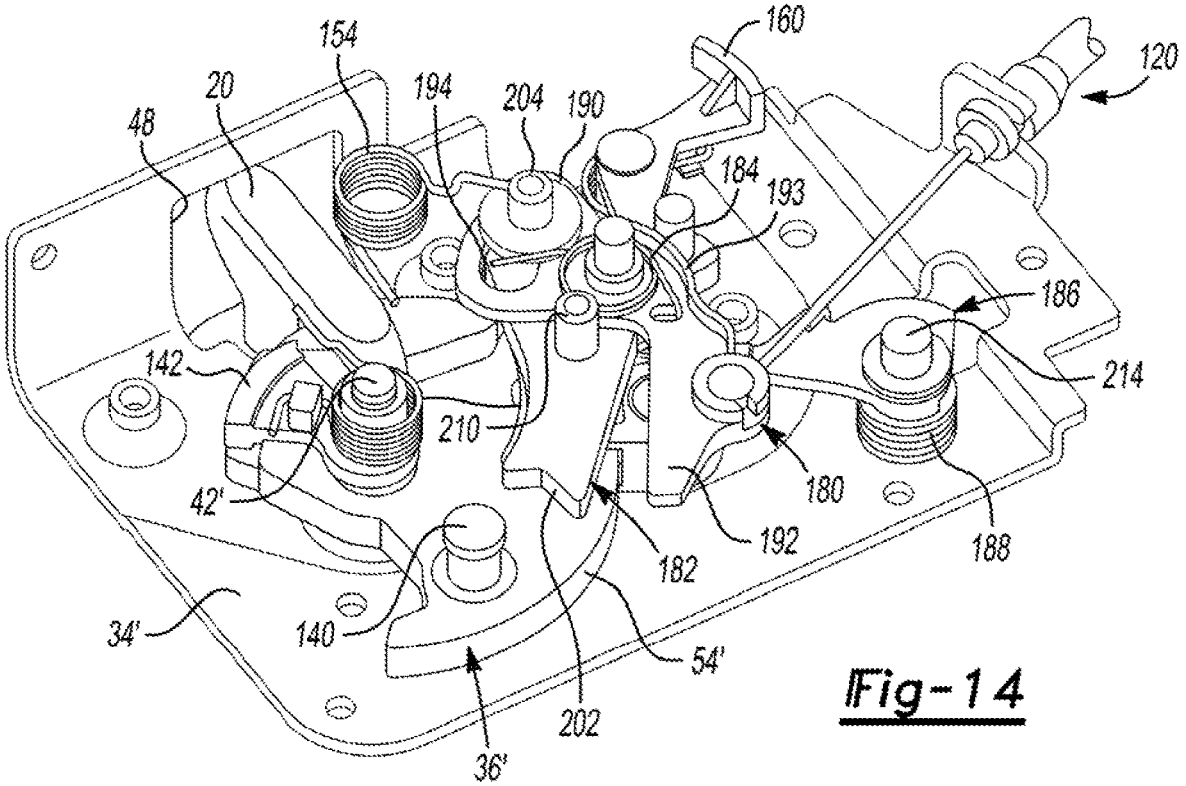
Figure 15:
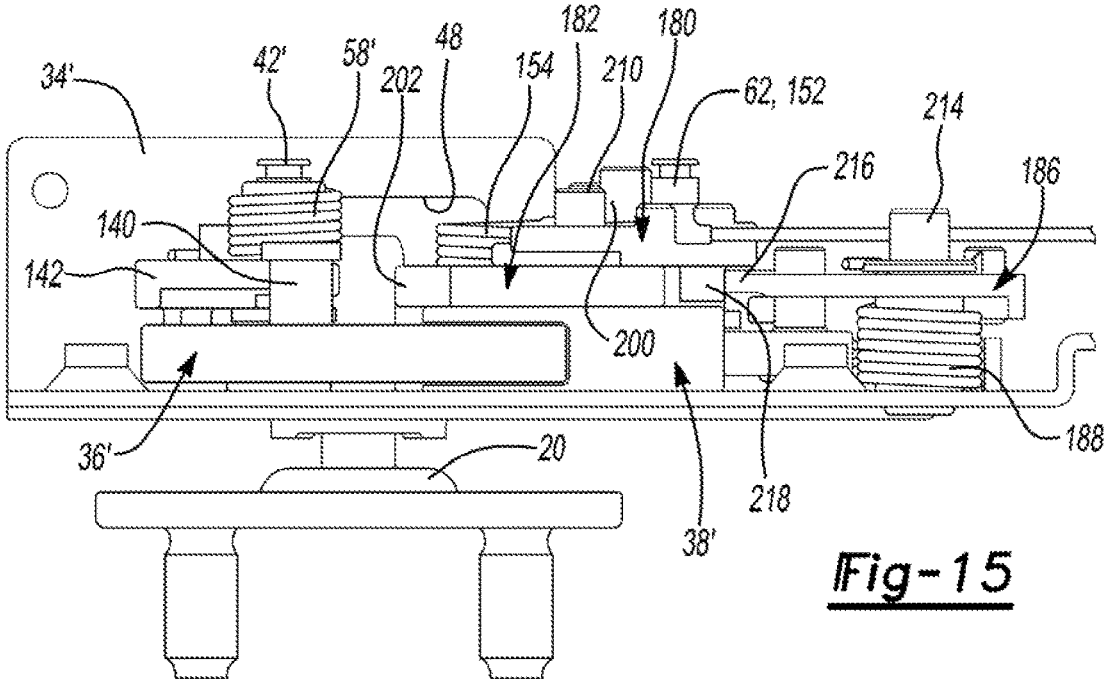

Second cinch lever leg 192 is shown connected via a ferrule 196 to a first end of a cable associated with cinch cable assembly 120. Cinch link 182 is an elongated member having a cinch link pivot 200 at a first end and a cinch link engagement feature or member, hereinafter referred to as drive notch 202, formed at a second end. Cinch link pivot 200 has a first drive pin segment (not shown) extending into and guided within lost motion slot 194 on first cinch lever leg 190 of cinch lever 180. A second drive pin segment 204 of cinch link pivot 200 extends through and is guided within a first drive slot 206 formed in release lever 150. A cinch link rivet 210 extending outwardly from cinch link 182 is retained within a second drive slot 212 formed in release lever 150. Cinch link spring 184 surround pivot post 152 and has its opposite end segments engaged with cinch lever 180 and cinch link 182. Cinch link spring 184 is arranged to normally bias cinch link 182 and cinch lever 180 in the direction shown by arrow 213 (FIG. 13). Auxiliary cinch lever 186 is pivotable about an auxiliary cinch lever pivot 214 and has an end lug segment 216 engaging a cam lug 218 (FIG. 15) formed on cinch lever 180. Auxiliary cinch lever spring 188 acts to normally bias end lug segment 216 into continuous engagement with cam lug 218.

Referring now to FIGS. 13 through 17, latch mechanism 132 is shown operating in a primary closed state, latch release mechanism 134 is shown operating in a non-actuated state, and latch cinch mechanism 136 is shown operating in a rest state. As such, door 16 is held in its fully-closed position with striker 20 retained in striker cavity 46 of ratchet 36' as ratchet 36' is held in its primary striker capture position by pawl 38' being located in its ratchet holding position via engagement of ball 74' between pawl engagement surface 68 on pawl 38' and primary latch notch 50 on ratchet 36'. With latch cinch mechanism 136 operating in its rest state, cinch lever 180 is located in a rest position and is operable for locating cinch link 182 in a rest position. With cinch link 182 located in its rest position, drive notch 202 is aligned with, but displaced from engagement with ratchet post 140. Since latch release mechanism 134 is operating in its non-actuated state, release lever 150 is shown located in its non-actuated position. FIG. 11 shows an overslam bumper 220 engaging ratchet 36' in its primary striker capture position and a release lever rest bumper 222 engaging release lever 150 in its non-actuated position.

Figure 18A:
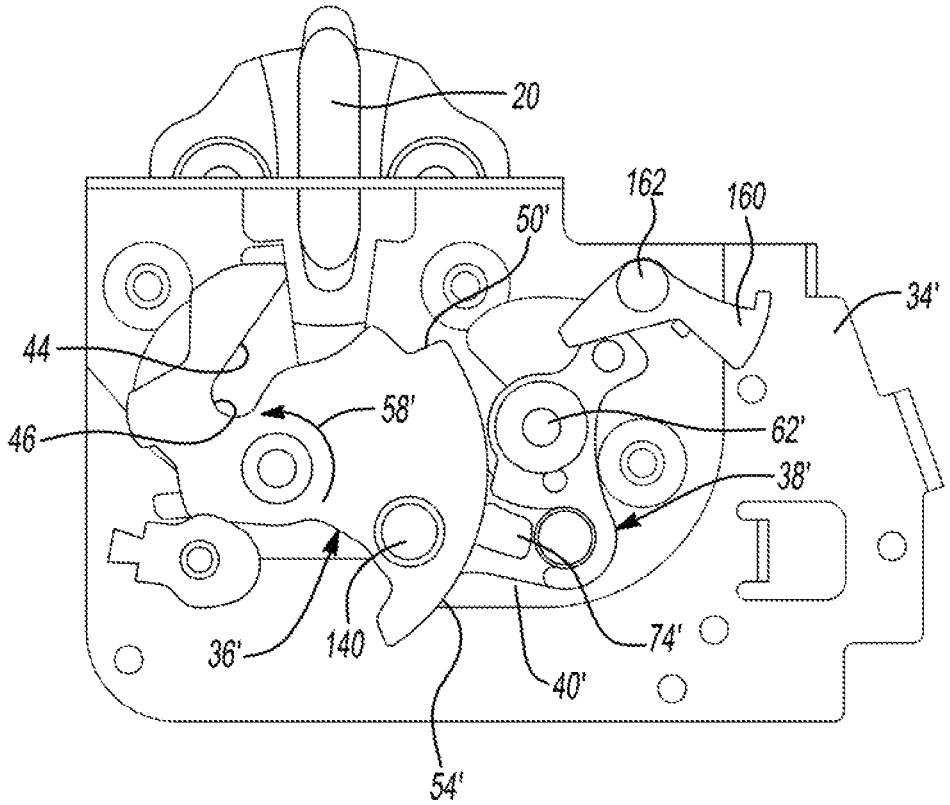
FIGS. 18A and 18B are plan views illustrating the orientation and positioning of components with the latch mechanism now operating in a released state, the latch release mechanism maintained in its non-actuated state, and the latch cinch mechanism now operating in a stand-by state.
Figure 18B:
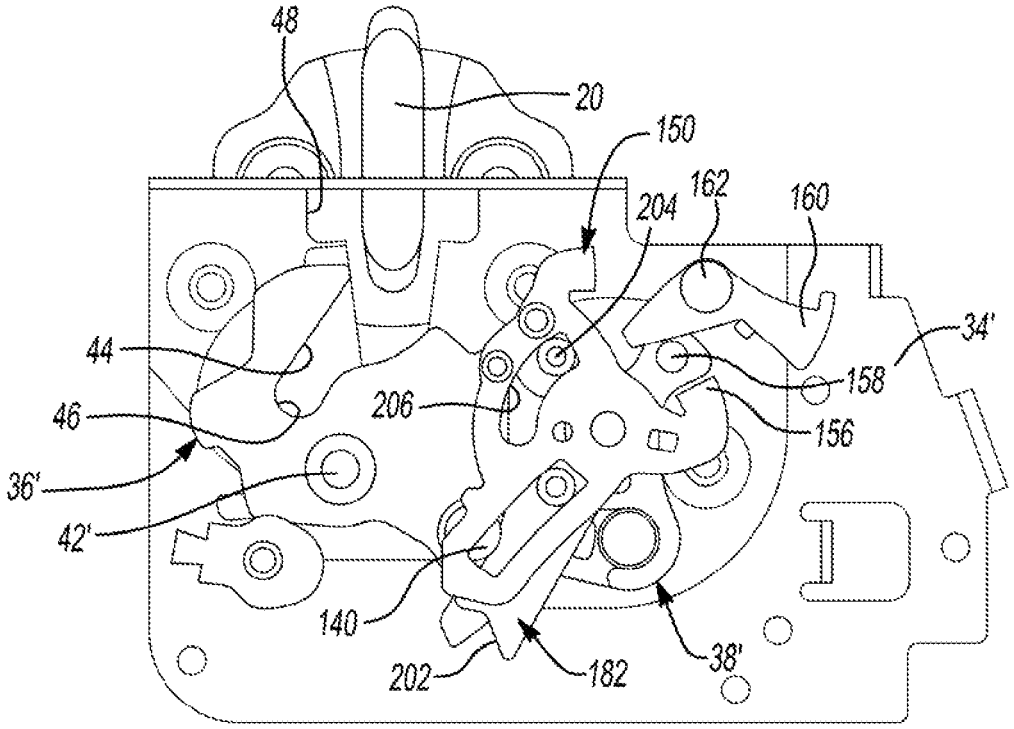

In contrast to latch mechanism 132 operating in its primary closed state (FIGS. 13-17), FIGS. 18A and 18B now illustrate latch mechanism 132 operating in a released state, latch release mechanism 134 operating in an actuated state, and latch cinch mechanism 136 operating in a stand-by state when door 16 has been opened and striker 20 is released from ratchet 36', which is now shown located in its striker release position. As seen, ball 74' engages edge cam surface 54' on ratchet 36' such that pawl 38' is held in its ratchet releasing position while release lever 150 is shown rotated to its actuated position. Such rotation of ratchet 36' to its striker release position, under the biasing applied thereto by ratchet spring 58', results in ratchet post 140 moving into engagement with a side edge surface of cinch link 182. As is understood, movement of release lever 150 from its non-actuated position into its actuated position causes pawl 36' to move from its ratchet holding position (FIG. 17) to its ratchet releasing position (FIG. 18A) which, in turn, allows ratchet spring 58' to drive ratchet 36' to its striker release position. Release lever 150 is subsequently returned to its non-actuated position following completion of the power release operation.

Figure 19A:
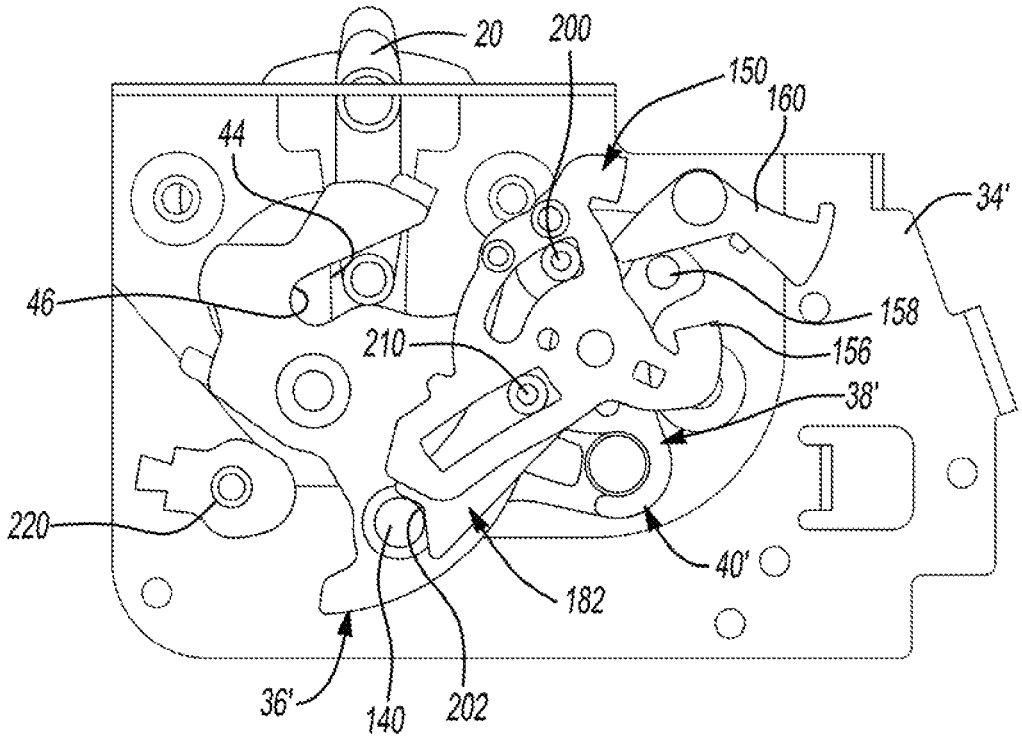
FIGS. 19A and 19B are plan views illustrating the orientation and positioning of components when the latch mechanism is shifted from its released state into an initial or secondary closed state and the latch cinch mechanism is shifted from its stand-by state into an engaged state.
Figure 19B:
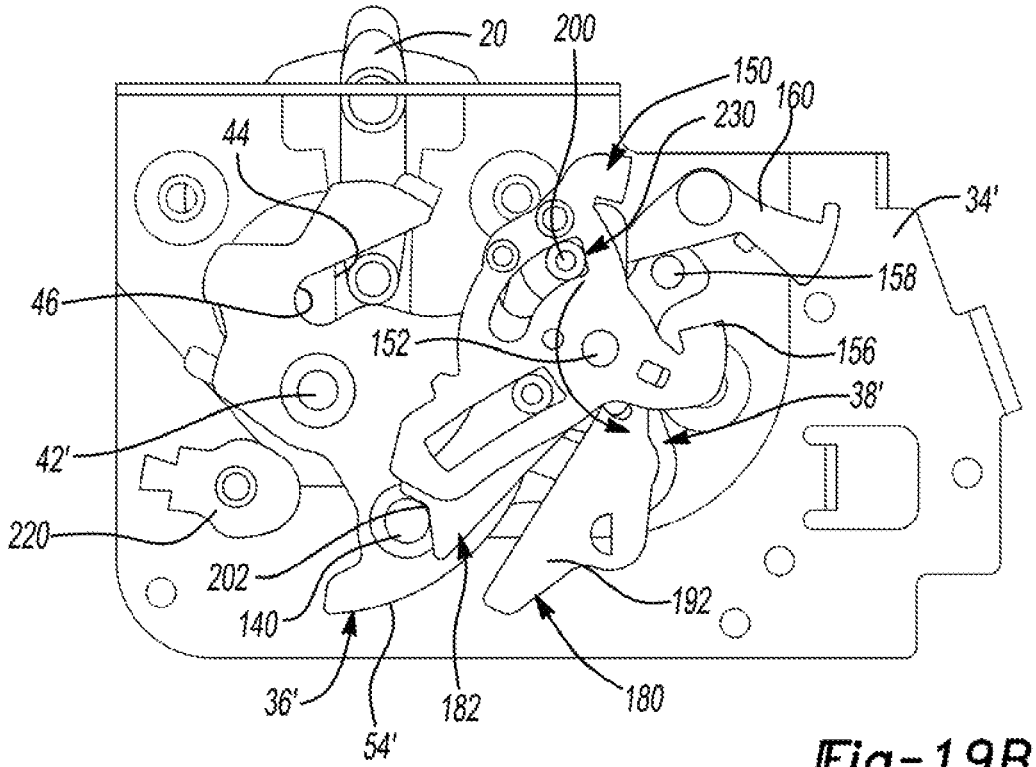

FIGS. 19A and 19B illustrate latch mechanism 132 shifted from its released state (FIGS. 18A and 18B) into its secondary closed state in response to door 16 being partially-closed (i.e. a soft close event) and also illustrate latch cinch mechanism 136 shifted from its stand-by state into an engaged state. Specifically, rotation of ratchet 36' from its striker release position into its secondary striker capture position causes cinch link 182 to pivot from its rest position into an engaged position such that drive notch 202 on cinch link 182 moves into engagement with ratchet post 140 on ratchet 36' and thereafter acts to mechanically hold ratchet 36' in its secondary striker capture position. Note that pawl 38' is retained in its ratchet releasing position by ball 74' continuing to engage cam edge 54' of ratchet 36'. Additionally, first drive pin segment of cinch link pivot 200 engages an end segment of lost motion slot 194 formed in cinch lever 180, as is indicated by arrow 230. In this position, cinch lever switch 170 actuates cinch position sensor 172 and sends a signal to the ECU that is used to initiate actuation of power cinch actuator 122. By having the secondary striker capture position of the ratchet 36' maintained by a dedicated lever (i.e. release lever 150), the blind spot problems associated with the cinch function can be overcome. Since the single cinch sensor 172 monitoring the cinch switch lever 170 associated with the release lever 150 (which does not change its position between secondary striker capture position and primary striker capture position of the ratchet 36') is used to determine when the power-operated cinch actuator 122 needs to be activated (i.e. when the ratchet 36' is in the secondary striker capture position), the reliance on the combination of a ratchet position and a pawl position switches, or additional switches, is not necessary, and the cinch malfunctions due to blind spots may be avoided.

Figure 16:
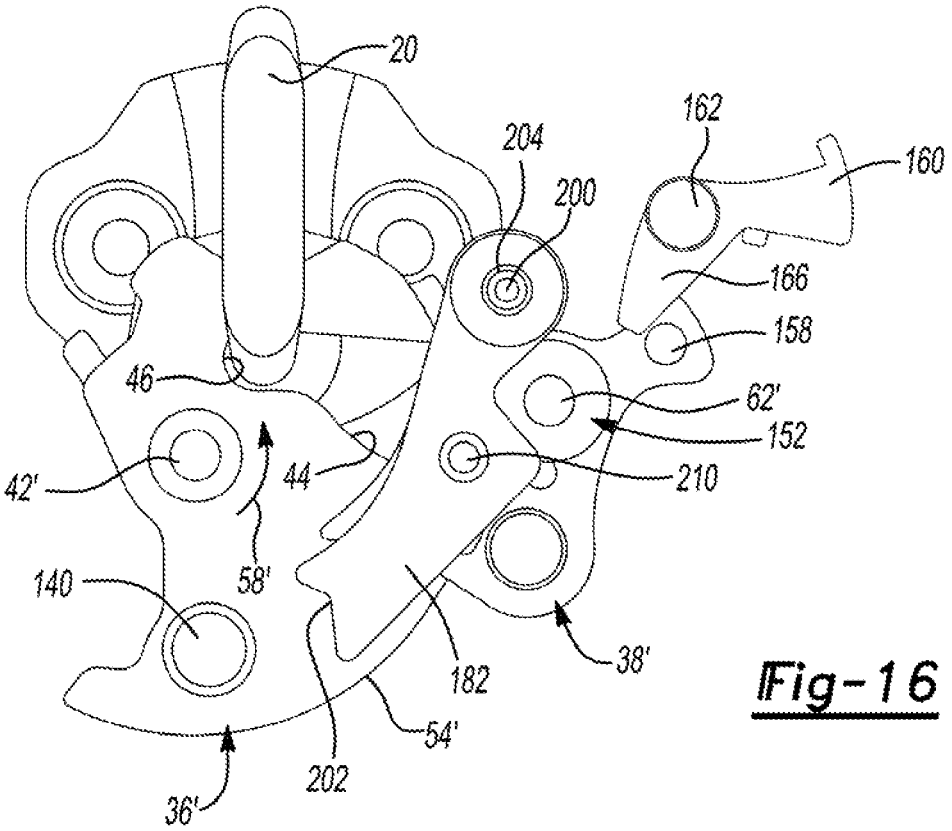
Figure 17:
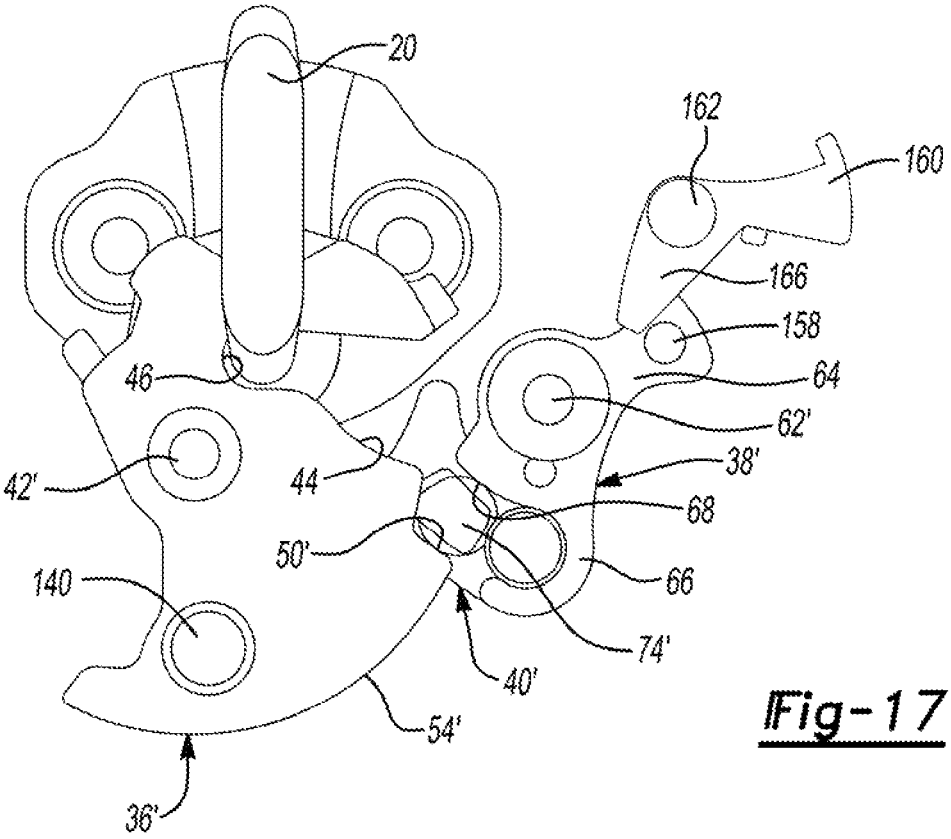
Figure 20A:
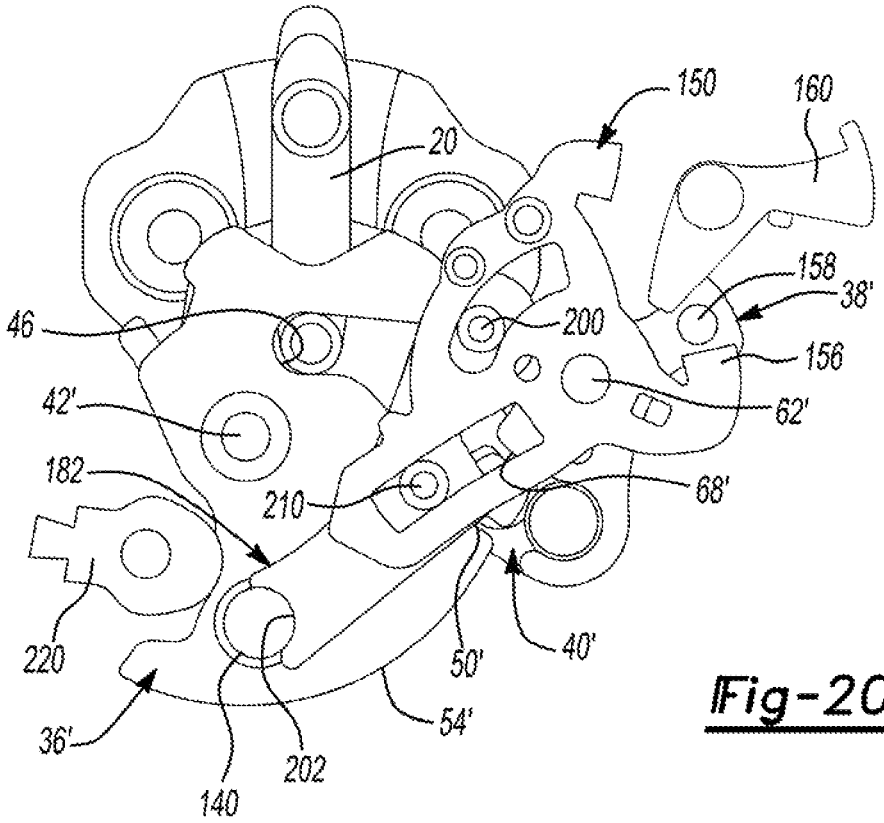
FIGS. 20A and 20B are additional plan views illustrating actuation of the power-operated cinch actuator for shifting the latch mechanism from its secondary closed state into its primary closed state while the latch cinch mechanism is maintained in its engaged state.
Figure 20B:
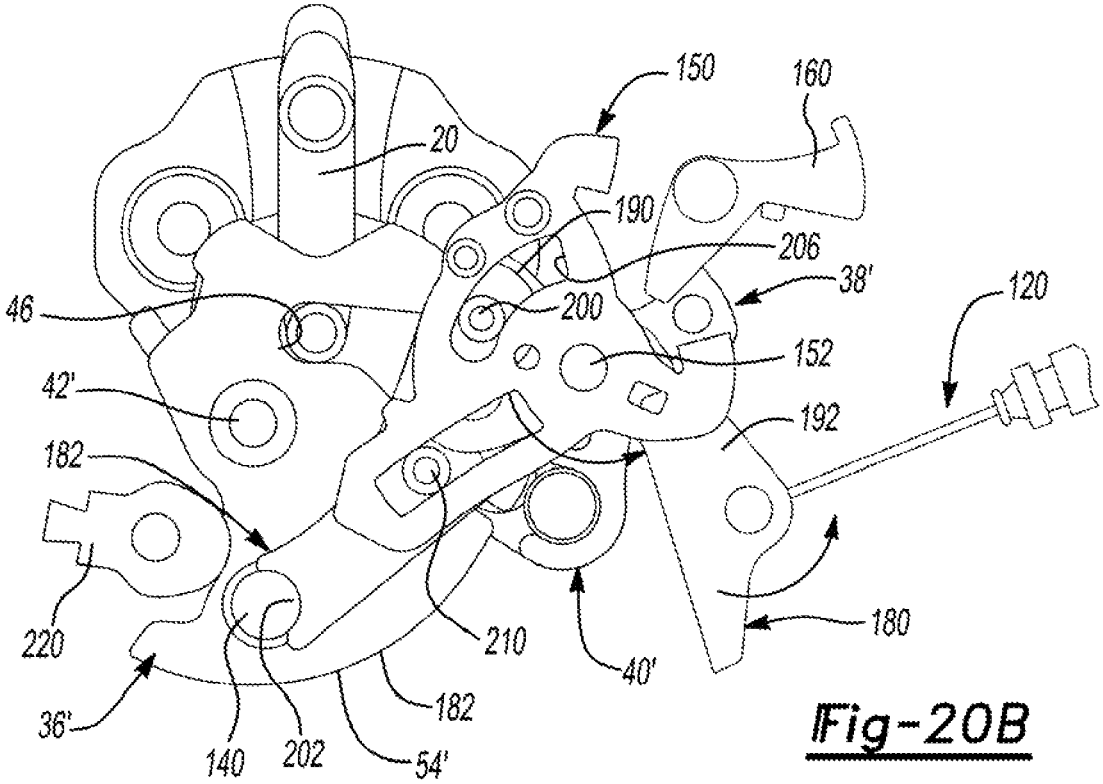

Actuation of power cinch actuator 122 causes latch cinch mechanism 136 to initiate cinching of ratchet 36' by mechanically rotating it from its secondary striker capture position (FIG. 19A) to is primary striker capture position (FIG. 16). The power cinching operation is illustrated in FIGS. 20A and 20B wherein movement of cinch lever 180 from its cinch start position into a cinch stop position (via pulling of cinch cable 120) causes the drive connection between the first drive pin on cinch link pivot 200 and slot 194 in cinch lever 180 to cause concurrent movement of cinch link 182 from its engaged position into a ratchet-cinched position for causing rotation of ratchet 36' from its secondary striker capture position into its primary striker capture position due to engagement of drive notch 202 on cinch link 182 with ratchet post 140 on ratchet 36'. This drive engagement functions to cause ratchet 36' to slightly over-travel past its primary striker capture position to allow roller ball 74' to disengage cam edge surface 54' and align with primary latch notch 50, thereby permitting pawl 38' to move into its ratchet holding position. As the cinch link 182 is moved, the cinch link 182 will pivot about the cinch link rivet 210 retained within the second drive slot 212 as caused by the movement of the second end of the cinch link 182 caused by the second drive pin segment 204 following the arcuate path of the first drive slot 206. As the cinch link 182 is moved, the orientation of the cinch link 182 will change to follow the rotational path of the ratchet post 140 relative to the ratchet pivot post 42 so as to ensure the force applied by the cinch link 182 upon the ratchet 36' is constantly maintained on the ratchet post 140 in the direction of travel of the cinch link 182.

Upon completion of this power cinching operation, ratchet 36' is held in its primary striker capture position by pawl 38' and latch cinch mechanism 136 is "reset" back into its rest state (FIG. 16). For example, to reset the latch cinch mechanism 136 into its rest state, the power release actuator 102 (or the manually-actuated inside or outside latch release actuator) may be actuated to pivot release lever 150 from its non-actuated position into its actuated position for moving the cinch link 182 to release lock notch 202 from ratchet post 140 e.g. by moving the cinch link rivet 210 as urged by the movement of the second drive slot 212. The disengagement of the latch cinch mechanism 136 is designed in such way the moment arm on the cinch link 182 does not decrease during the cinch function, which allows to lower the disengagement efforts i.e. the distance between the cinch link rivet 210 retained within the second drive slot 212 and the release lever pivot post 152 rather increases during the cinch function which increases the force the second drive slot 212 applies on the pin 140 due to the rotation of the pivot release lever 150.

FIGS. 21A through 21C illustrate a cinch "override" operation to shift latch cinch mechanism 136 from its actuated state into an override-released state. Specifically, power release actuator 102 (or the manually-actuated inside or outside latch release actuator) is actuated to pivot release lever 150 from its non-actuated position into its actuated position for driving pawl 38' to its ratchet releasing position and moving cinch link 182 to release lock notch 202 from ratchet pin 140.

In an alternative arrangement, cinch link 182 can remain engaged with ratchet 36' (via lock notch 202 and ratchet post 140) when ratchet 36' is located in its primary striker capture position. As such, subsequent actuation of latch release mechanism 134 will cause release lever 150 to move pawl 38' and cinch link 180 concurrently to release ratchet 36' for movement to its striker release position.

FIGS. 22A-22G provide a series of sequential views illustrating movement of the various components associated with shifting of latch mechanism 132 from its released state (FIG. 22A) into its secondary closed state (FIG. 22C) via engagement of striker 20 with ratchet 36' during movement of door 16 from its open position to its partially-closed position. As noted, this action results in movement of cinch link 182 relative to ratchet 36' until drive notch 202 is aligned with and engaging ratchet post 140. At this point, the power cinching operation is initiated via actuation of power cinch actuator 122 such that cinch link 180 mechanically drives ratchet 36' from its secondary capture position to its primary striker capture position (see FIGS. 22C through 22F). In this manner, latch mechanism 132 is shifted from its secondary closed state into its primary closed state. Following completion of the power cinching operation, cinch link 182 is uncoupled from ratchet 36' (FIG. 22G) with pawl 38' functioning to hold ratchet 36' in its primary striker capture position.

The present invention provides a simple and compact design of latch assembly 118 having a ratchet 36' with a one tooth (primary latch notch 50') profile engaged only by the pawl 38' in the primary striker capture position. As noted, the secondary striker capture position for the ratchet 36' is obtained via engagement of ratchet-mounted post 140 engaged and held by a cinch component (cinch link 182) of a cinching mechanism. The release lever 150 has a profile configured to guide the cinch link 182 during the power cinching function and which is also used for cinch disengage and latch release in any ratchet position. The disengage arrangement is designed such that the moment arm on the cinch link 182 does not decrease during the cinching operation, thereby permitting lower disengagement efforts.

While cinching mechanism 136 is shown operably associated with roller-type single ratchet/pawl latch mechanism 132, those skilled in the art will recognize that alternative single and double ratchet/pawl latch mechanisms can be used, provided the cinching mechanism is configured to establish the secondary closed state without direct latching engagement between the ratchet and pawl. Likewise, alternative arrangements for cinch actuator 122 and cinch cable 120 can be provided for selectively moving cinch lever 180 between its rest and cinch position to initiate and complete the power cinching operation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch assembly for a motor vehicle, comprising:

a latch mechanism including a ratchet having a ratchet latch feature and a ratchet engagement feature, a ratchet biasing member, a pawl, and a pawl biasing member, the ratchet being moveable between a striker release position whereat the ratchet is positioned to release a striker and two distinct striker capture positions whereat the ratchet is positioned to retain the striker, the two distinct striker capture positions including a secondary striker capture position and a primary striker capture position, the ratchet biasing member configured to bias the ratchet toward its striker release position, the pawl being moveable between a ratchet holding position whereat the pawl engages the ratchet latch feature and holds the ratchet in its primary striker capture position and a ratchet releasing position whereat the pawl is disengaged from the ratchet latch feature, the pawl being located in its ratchet releasing position when said ratchet is located in its striker release and secondary striker capture positions, the pawl biasing member configured to bias the pawl toward its ratchet holding position; and a latch cinch mechanism operable to engage the ratchet engagement feature in response to movement of the ratchet from its striker release position into its secondary striker capture position and to maintain engagement with the ratchet engagement feature for holding the ratchet in its secondary striker capture position while the pawl is located in its ratchet releasing position;

a latch release mechanism for moving the pawl between a non-actuated position whereat the pawl is located in its ratchet holding position and an actuated position whereat the pawl is located in its ratchet releasing position, wherein the latch release mechanism comprises a profile configured to disengage the latch cinch mechanism from the ratchet engagement feature;

wherein the latch release mechanism includes a release lever for moving the pawl between the non-actuated position whereat the pawl is located in its ratchet holding position and the actuated position whereat the pawl is located in its ratchet releasing position, and wherein the latch cinch mechanism includes a cinch link that is operatively coupled to the release lever to coordinate relative movement therebetween.

2. The closure latch assembly of claim 1, wherein the latch cinch mechanism is further operable to move the ratchet from its secondary striker capture position into its primary striker capture position due to continued engagement with the ratchet engagement feature whereat the pawl is permitted to move into engagement with the latch feature on the ratchet for holding the ratchet in its primary striker capture position.

3. The closure latch assembly of claim 2, wherein the cinch link has a cinch link engagement feature, the cinch link being moveable between a rest position and an engaged position, wherein the cinch link engagement feature is disengaged from the ratchet engagement feature when the cinch link is located in its rest position and the ratchet is located in its striker release position, and wherein the cinch link engagement feature is engaged with the ratchet engagement feature when the cinch link is located in its engaged position and the ratchet is located in its secondary striker capture position such that the cinch link engagement feature holds the ratchet in its secondary striker capture position to prevent movement of the ratchet toward its striker release position.

4. The closure latch assembly of claim 3, wherein the latch cinch mechanism includes a cinch actuator operable for causing the cinch link to move from its engaged position to its ratchet cinched position causes the ratchet to move from its secondary striker capture position into its primary striker capture position due to engagement between the cinch link engagement feature and the ratchet engagement feature.

5. The closure latch assembly of claim 3, wherein the ratchet latch feature is a latch shoulder formed on the ratchet, wherein the ratchet engagement feature is a ratchet post extending from the ratchet, and wherein the cinch link engagement feature is a lock notch that is selectable engageable with the ratchet post.

6. The closure latch assembly of claim 5, wherein the pawl includes a pawl engagement feature that includes a roller configured to engage the latch shoulder on the ratchet when the pawl is located in its ratchet holding position and the ratchet is located in its primary striker capture position, and wherein the roller of the pawl engagement feature rides against an edge surface of the ratchet configured to hold the pawl in its ratchet releasing position when the ratchet is located in either of its striker release and secondary striker capture positions.

7. The closure latch assembly of claim 4, wherein the closure latch assembly is mounted to one of a vehicle door and a vehicle body and the striker is mounted to the other one of the vehicle door and the vehicle body, wherein the latch mechanism is operating in a released state and the latch cinch mechanism is operating in a rest state when the vehicle door is located in an open position relative to the vehicle body such that the ratchet is located in its striker release position and the cinch link is located in its rest position, wherein the latch mechanism is operating in a secondary closed state and the latch cinch mechanism is operating in an engaged state when the vehicle door is moved to a partially-closed position relative to the vehicle body such that the striker forcibly moves the ratchet from its striker release position to its secondary striker capture position and the cinch link is permitted to move from its rest position to its engaged position, and wherein the latch mechanism is operating in a primary closed state and the latch cinch mechanism is operating in a latch cinched state when the latch cinch mechanism is actuated by the cinch actuator to provide a cinching function by moving the cinch link from its engaged position into its ratchet cinched position so as to move the ratchet from its secondary striker capture position into its primary striker capture position due to engagement of the cinch link engagement feature with the ratchet engagement feature.

8. The closure latch assembly of claim 7, wherein a power resetting function is subsequently initiated to cause the cinch actuator to disengage the cinch link engagement feature from the ratchet engagement feature while the pawl is located in its ratchet holding position for holding the ratchet in its primary striker capture position.

9. The closure latch assembly of claim 3, wherein the latch cinch mechanism further includes a cinch lever and a power-operated cinch actuator, the cinch lever being moveable between a rest position whereat the cinch lever locates the cinch link in its rest position and an actuated position whereat the cinch lever moves the cinch link from its engaged position to its ratchet cinched position, and wherein the power-operated cinch actuator is operable to move the cinch lever between its rest and actuated positions for providing a power cinching function.

10. The closure latch assembly of claim 9, wherein the cinch link is biased by a cinch link biasing member toward its engaged position.

11. The closure latch assembly of claim 9, wherein the cinch link has a cinch link pivot post retained in a lost motion slot formed in the cinch lever to coordinate relative movement therebetween.

12. The closure latch assembly of claim 3, further comprising:

a cinch actuation mechanism operable for moving the cinch link from its engaged position to a ratchet cinched position for causing the ratchet to move from its secondary striker position into its primary striker position due to engagement of the cinch link engagement member with the ratchet engagement member so as to permit the pawl to move into its ratchet holding position for holding the ratchet in its primary striker capture position.

13. The closure latch assembly of claim 12, wherein the closure latch assembly is mounted to one of a vehicle door and a vehicle body and the striker is mounted to the other one of the vehicle door and the vehicle body, wherein the latch mechanism is operating in a released state and the latch cinch mechanism is operating in a rest state when the vehicle door is located in an open position relative to the vehicle body such that the ratchet is located in its striker release position and the cinch link is located in its rest position, wherein the latch mechanism is operating in a secondary closed state and the latch cinch mechanism is operating in an engaged state when the vehicle door is moved to a partially-closed position relative to the vehicle body such that the striker forcibly moves the ratchet to its secondary striker capture position and the cinch link is permitted to move to its engaged position, and wherein the latch mechanism is operating in a primary closed state and the latch cinch mechanism is operating in a latch cinched state when the cinch actuation mechanism is actuated to provide a cinching function by moving the cinch link from its engaged position into its ratchet cinched position so as to move the ratchet from its secondary striker capture position into its primary striker capture position due to engagement of the cinch link engagement member with the ratchet engagement member.

14. The closure latch assembly of claim 12, wherein the cinch actuation mechanism includes a cinch lever and a power-operated cinch actuator, the cinch lever being moveable between a rest position whereat the cinch lever locates the cinch link in its rest position and an actuated position whereat the cinch lever moves the cinch link from its engaged position to its ratchet cinched position, and wherein the power-operated cinch actuator is operable to move the cinch lever between its rest and actuated positions for providing a power cinching function.

15. The closure latch assembly of claim 3, further comprising:

a cinch actuation mechanism operable for moving the cinch link to drive the cinch link engagement member into the ratchet engagement member upon feedback from a first sensor associated with the release lever that the ratchet is located in its secondary striker capture position, whereby the ratchet is driven to its primary striker capture position and the pawl is permitted to move to its ratchet holding position.

16. The closure latch assembly of claim 15, wherein the cinch actuation mechanism is operable to stop moving the cinch link from driving the cinch link engagement member into the ratchet engagement member upon feedback from a second sensor that the ratchet is located in at least one of its primary striker capture position and in an over travel position from its primary striker capture position.

17. The closure latch assembly of claim 15, wherein the cinch actuation mechanism is operable to stop moving the cinch link from driving the cinch link engagement member into the ratchet engagement member upon feedback from a second sensor that the ratchet is located in an over travel position from its primary striker capture position.

18. The closure latch assembly of claim 16, wherein the second sensor is configured to provide a signal when the ratchet moves to its primary striker capture position, and the first sensor is configured to provide a signal when the latch cinch mechanism moves to an actuated position indicating the ratchet is located in its secondary striker capture position.

19. The closure latch of claim 1, wherein the latch release mechanism includes the release lever.

20. The closure latch of claim 19, wherein the release lever comprises a slot as the profile for guiding the cinch link during an operation of the latch cinch mechanism to move the ratchet from its secondary striker capture position into a primary striker capture position and for guiding the cinch link to disengage the ratchet engagement feature when the release lever moves from the non-actuated to the actuated position.

21. A closure latch assembly for a motor vehicle, comprising:

a latch mechanism including a ratchet having a ratchet latch feature and a ratchet engagement feature, a ratchet biasing member, a pawl, and a pawl biasing member, the ratchet being moveable between a striker release position whereat the ratchet is positioned to release a striker and two distinct striker capture positions whereat the ratchet is positioned to retain the striker, the two distinct striker capture positions including a secondary striker capture position and a primary striker capture position, the ratchet biasing member configured to bias the ratchet toward its striker release position, the pawl being moveable between a ratchet holding position whereat the pawl engages the ratchet latch feature and holds the ratchet in its primary striker capture position and a ratchet releasing position whereat the pawl is disengaged from the ratchet latch feature, the pawl being located in its ratchet releasing position when said ratchet is located in its striker release and secondary striker capture positions, the pawl biasing member configured to bias the pawl toward its ratchet holding position; and a latch cinch mechanism operable to engage the ratchet engagement feature in response to movement of the ratchet from its striker release position into its secondary striker capture position and to maintain engagement with the ratchet engagement feature for holding the ratchet in its secondary striker capture position while the pawl is located in its ratchet releasing position;

a latch release mechanism for moving the pawl between a non-actuated position whereat the pawl is located in its ratchet holding position and an actuated position whereat the pawl is located in its ratchet releasing position, wherein the latch release mechanism comprises a profile configured to disengage the latch cinch mechanism from the ratchet engagement feature;

wherein the latch cinch mechanism is disengaged from the ratchet engagement feature concurrently with movement of the pawl by the latch release mechanism.

22. A closure latch assembly for a motor vehicle, comprising:

a latch mechanism including a ratchet having a ratchet latch feature and a ratchet engagement feature, a ratchet biasing member, a pawl, and a pawl biasing member, the ratchet being moveable between a striker release position whereat the ratchet is positioned to release a striker and two distinct striker capture positions whereat the ratchet is positioned to retain the striker, the two distinct striker capture positions including a secondary striker capture position and a primary striker capture position, the ratchet biasing member configured to bias the ratchet toward its striker release position, the pawl being moveable between a ratchet holding position whereat the pawl engages the ratchet latch feature and holds the ratchet in its primary striker capture position and a ratchet releasing position whereat the pawl is disengaged from the ratchet latch feature, the pawl being located in its ratchet releasing position when said ratchet is located in its striker release and secondary striker capture positions, the pawl biasing member configured to bias the pawl toward its ratchet holding position; and a latch cinch mechanism operable to engage the ratchet engagement feature in response to movement of the ratchet from its striker release position into its secondary striker capture position and to maintain engagement with the ratchet engagement feature for holding the ratchet in its secondary striker capture position while the pawl is located in its ratchet releasing position;

a latch release mechanism for moving the pawl between a non-actuated position whereat the pawl is located in its ratchet holding position and an actuated position whereat the pawl is located in its ratchet releasing position, wherein the latch release mechanism comprises a profile configured to disengage the latch cinch mechanism from the ratchet engagement feature;

wherein the latch release mechanism disengages the latch cinch mechanism from the ratchet engagement feature during a moving of the pawl form its non-actuated position to its actuated position.

* * * * *